US009320938B1

(12) United States Patent
Belmore

(10) Patent No.: US 9,320,938 B1
(45) Date of Patent: Apr. 26, 2016

(54) PORTABLE FULL-BODY WORKOUT SYSTEM AND METHOD OF USING SAME

(71) Applicant: Paul T. Belmore, Allen, TX (US)

(72) Inventor: Paul T. Belmore, Allen, TX (US)

( * ) Notice: Subject to any disclaimer, the term of this patent is extended or adjusted under 35 U.S.C. 154(b) by 36 days.

(21) Appl. No.: 14/527,999

(22) Filed: Oct. 30, 2014

(51) Int. Cl.

| | |
|---|---|
| ***A63B 21/072*** | (2006.01) |
| ***A63B 21/075*** | (2006.01) |
| ***A63B 21/00*** | (2006.01) |
| ***A63B 21/06*** | (2006.01) |
| ***B65D 81/18*** | (2006.01) |
| ***B65D 81/36*** | (2006.01) |

(52) U.S. Cl.
CPC ..... *A63B 21/075* (2013.01); *B65D 81/18* (2013.01); *B65D 81/365* (2013.01)

(58) Field of Classification Search
CPC ..... A63B 21/0004; A63B 21/00043; A63B 21/06; A63B 21/0601; A63B 21/0602; A63B 21/0603; A63B 21/0604; A63B 21/0605; A63B 21/0606; A63B 21/0607; A63B 21/0608; A63B 21/0609; A63B 21/065; A63B 21/075; A63B 21/4001; A63B 21/4005; A63B 21/4017; A63B 21/4019; A63B 21/4027; A63B 21/4033; A63B 21/4035; A63B 21/4041; A63B 21/4043; A63B 55/408; A63B 2225/66; A63B 2225/68; A63B 2225/682; A45F 3/14; A45F 5/10; A45F 5/1026; A45F 2003/142; A45F 2005/1013; A45F 2005/1073; A45F 2200/0583; F25D 3/08; F25D 3/107; F25D 2303/00; F25D 2303/08; F25D 2400/12; A45C 7/0086; A45C 13/28; A45C 2013/306; B65D 81/18; B65D 81/365
USPC ..... 62/457.1–466; 220/592.03, 752–776; 224/257–258, 600–622, 925; 294/141–142, 152
See application file for complete search history.

(56) References Cited

U.S. PATENT DOCUMENTS

| | | | | |
|---|---|---|---|---|
| 4,796,758 | A * | 1/1989 | Hauk | A45C 11/20 206/545 |
| 5,407,218 | A * | 4/1995 | Jackson | A45C 5/14 280/30 |
| D359,090 | S | 6/1995 | Van Der Hoeven | |
| 5,429,288 | A * | 7/1995 | Sattler | A45F 3/14 224/257 |
| 5,580,343 | A | 12/1996 | Cafiero | |
| 6,296,165 | B1 * | 10/2001 | Mears | A45C 3/00 150/107 |
| 6,609,626 | B2 * | 8/2003 | Young | A45C 13/002 150/154 |
| 6,702,168 | B2 * | 3/2004 | Panosian | A45C 5/00 220/694 |
| 7,137,935 | B2 | 11/2006 | Clarke | |
| 7,140,507 | B2 * | 11/2006 | Maldonado | A45C 11/20 220/23.83 |
| 7,951,020 | B2 | 5/2011 | Castor | |

(Continued)

FOREIGN PATENT DOCUMENTS

| | | | |
|---|---|---|---|
| EP | 2425879 | A2 | 7/2012 |

*Primary Examiner* — Oren Ginsberg
*Assistant Examiner* — Joshua Lee
(74) *Attorney, Agent, or Firm* — Wei Wei Jeang; Grable Martin Fulton PLLC

(57) ABSTRACT

A full-body workout system comprises a cooler having a hinged lid and defining an insulated compartment and an adjustable weighted bottom portion, at least two drink bottles having an adjustable weighted bottom portion and configured for releasable attachment to the cooler, at least one cooler handle configured for releasable attachment to the cooler and the at least two drink bottles, a full-body workout strap having a strap body with first and second ends, each end including a padded hand grip and a latching mechanism configured for releasable attachment to the cooler, wherein the cooler may be carried by at least the at least one cooler handle and the full-body workout strap.

21 Claims, 46 Drawing Sheets

(56) References Cited

U.S. PATENT DOCUMENTS

| | | | | |
|---|---|---|---|---|
| 8,197,392 | B2 | 6/2012 | Silverman | |
| 8,721,507 | B2 | 5/2014 | Blancher | |
| 8,814,762 | B2 | 8/2014 | Butler | |
| 2004/0035143 | A1* | 2/2004 | Mogil | A45C 7/0077 62/457.2 |
| 2005/0029272 | A1* | 2/2005 | Padilla | A45C 13/00 220/735 |
| 2005/0072181 | A1* | 4/2005 | Mogil | A45C 11/20 62/457.7 |
| 2006/0196882 | A1* | 9/2006 | Shimazaki | B65D 25/32 220/737 |
| 2007/0131726 | A1* | 6/2007 | Aliev | A45F 3/14 224/184 |
| 2011/0237410 | A1 | 9/2011 | Perez | |
| 2011/0266107 | A1* | 11/2011 | Hansen | A45C 5/14 190/18 A |
| 2013/0143724 | A1 | 6/2013 | Demeo | |
| 2013/0196831 | A1 | 8/2013 | Kinsbourne | |
| 2013/0247606 | A1* | 9/2013 | Suchecki | F25D 3/08 62/457.2 |
| 2014/0202982 | A1 | 7/2014 | Willows | |
| 2014/0262885 | A1* | 9/2014 | Green | B25H 3/02 206/372 |
| 2015/0008242 | A1* | 1/2015 | Kpabar, Jr. | B67D 3/0061 222/183 |
| 2015/0241107 | A1* | 8/2015 | Mech | F25D 3/08 220/592.01 |

* cited by examiner

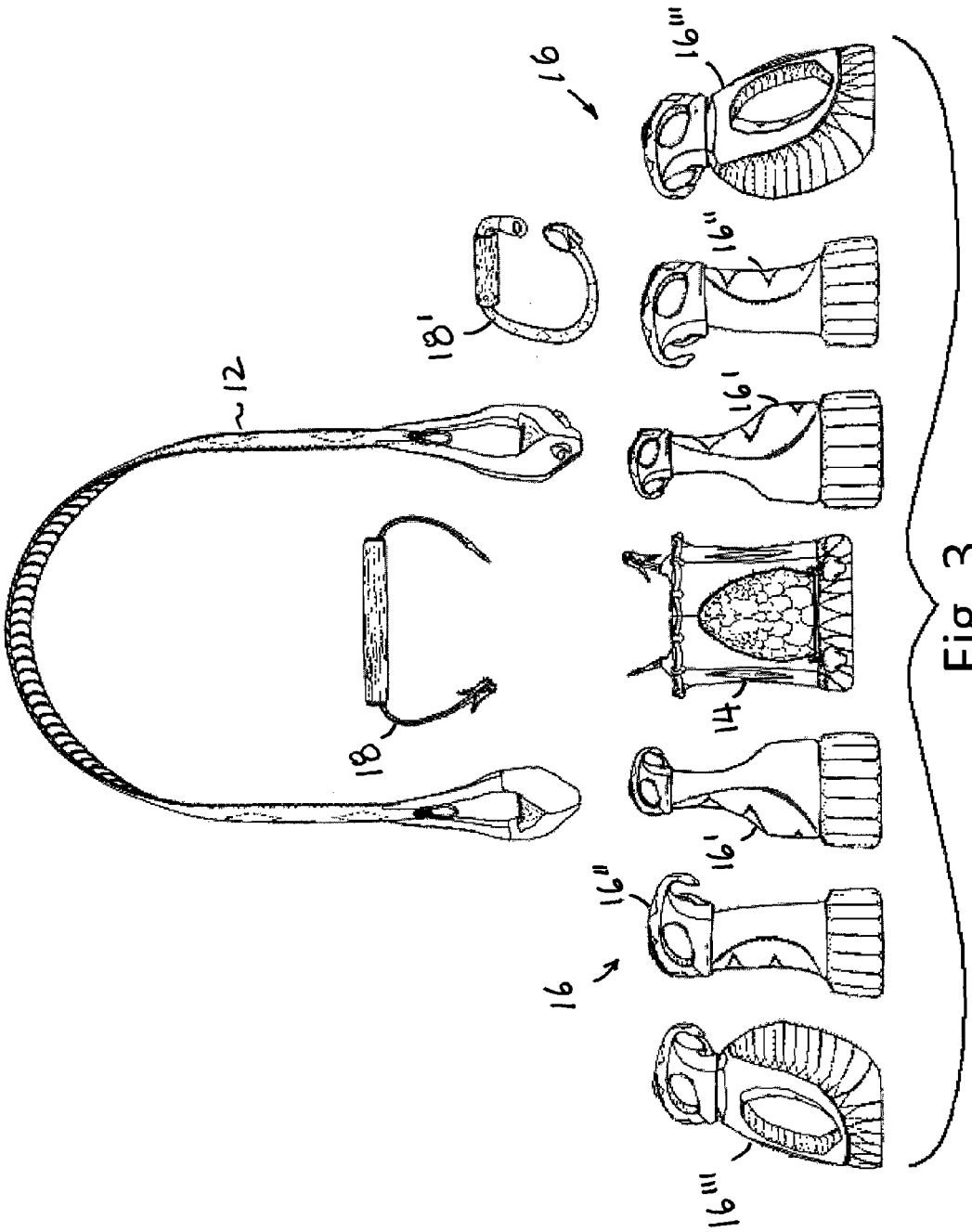
91
91
91

28
18
30
31
14
16
28'
18'
30'
32
32'

Fig. 13A
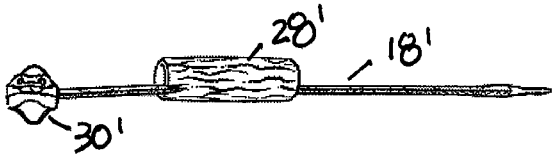
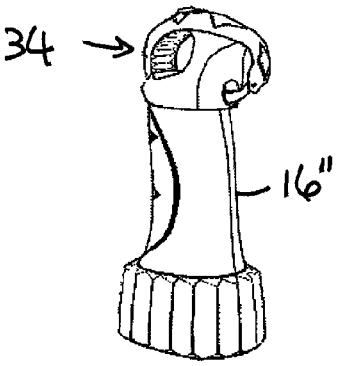
Fig. 13B
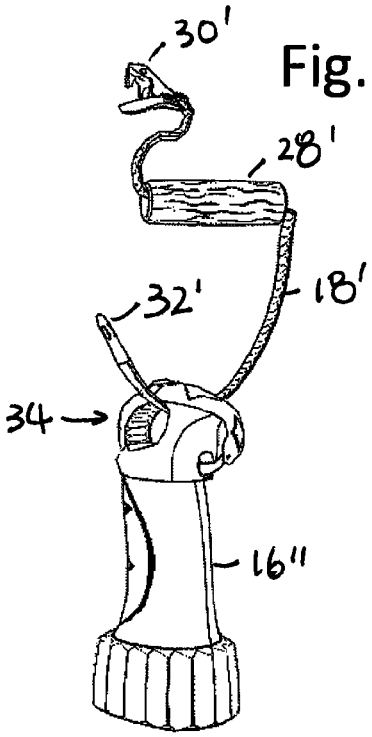
Fig. 13C
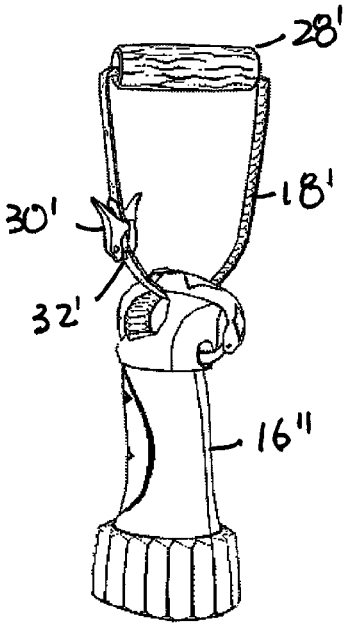

12
72
70
74
72

12
72
78
76
78
76
74
70
72

72
12
70
76
72

PORTABLE FULL-BODY WORKOUT SYSTEM AND METHOD OF USING SAME

FIELD

The present disclosure generally relates to the field of exercise equipment, and more particularly to a portable full-body workout system and method of using same.

BACKGROUND

It's been long recognized that exercise and physical activity are crucial components of physical fitness and overall health and wellness. A well-rounded fitness program includes strength training to improve bone and joint function, bone density, muscle, tendon and ligament strength, as well as aerobic exercise to improve heart and lung fitness, flexibility, and balance. Resistance and weight training involve the use of resistance to muscular contraction to build strength and anaerobic endurance of skeletal muscles. In addition to the use of one's own body weight, many different types of equipment have been conceived for facilitating aerobic and anaerobic exercises, such as free weights, weight machines, medicine balls, and resistance bands.

BRIEF DESCRIPTION OF THE DRAWINGS

FIG. 3 is front view of an exemplary embodiment of a portable full-body workout system showing all of the components detached from one another according to the present disclosure;

FIGS. 13A-13C are various views of an exemplary embodiment of a drink bottle component of the portable full-body workout system with a cooler handle strap fastened configuration according to the present disclosure;

DETAILED DESCRIPTION

The present disclosure is directed to a full-body workout system 10 that is versatile, portable, and easy to use. The portable full-body workout system 10 includes components that have dual-purposes, such as a cooler and drink bottles that serve as weights. The portable full-body workout system 10 is versatile and can be taken along on a walk, a hike, or a picnic and can be used virtually anywhere for resistance training to work various muscle groups of the body.

Figure 1B:
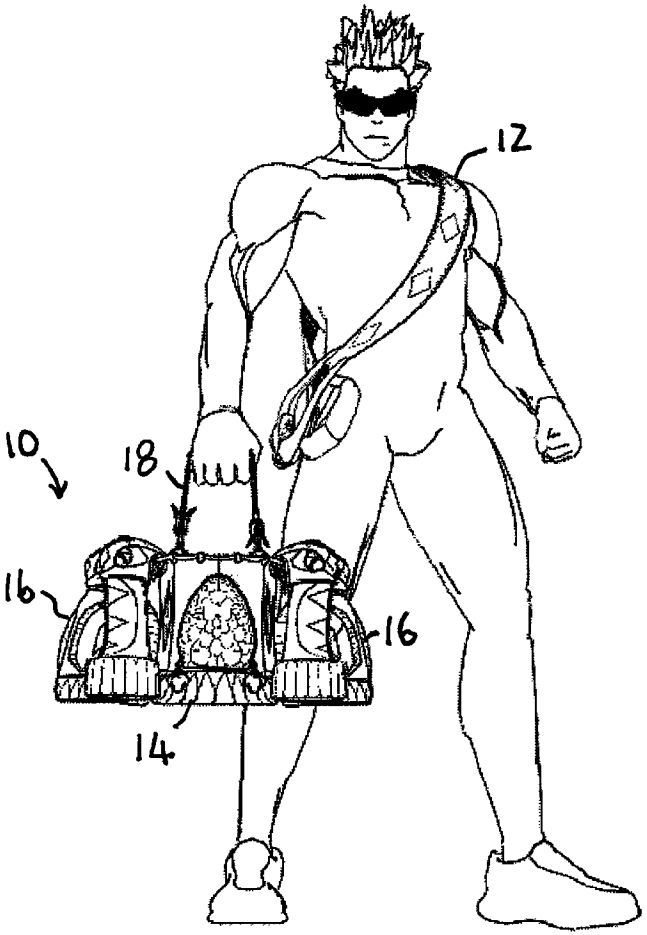
FIG. 1B is a perspective view of an exemplary embodiment of a portable full-body workout system shown carried by a user using the cooler handle according to the present disclosure.
Figure 1A:
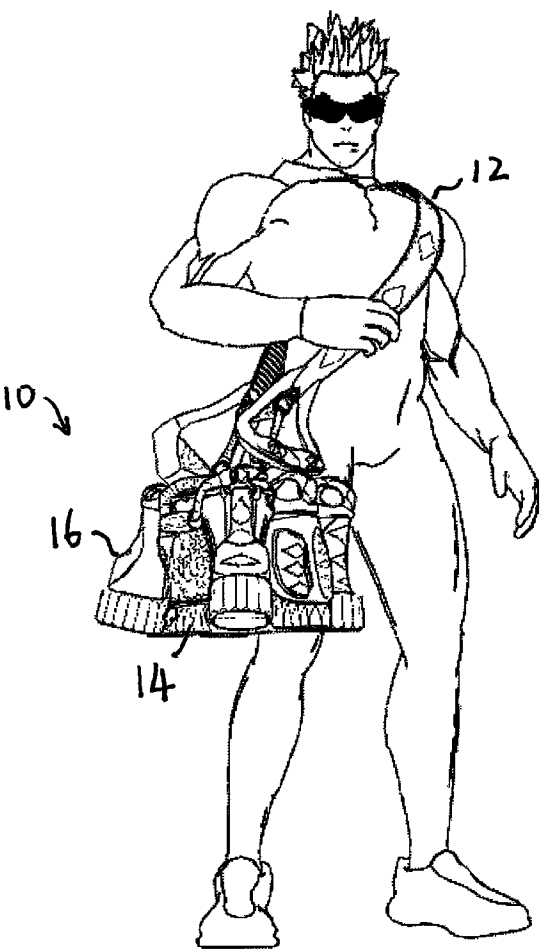
FIG. 1A is a perspective view of an exemplary embodiment of a portable full-body workout system shown carried by a user using the full-body workout strap according to the present disclosure.

FIG. 1A is a perspective view of an exemplary embodiment of a portable full-body workout system 10 shown carried by a user using a full-body workout strap 12 according to the present disclosure. The portable full-body workout system 10 includes several components that are described in more detail below. The portable full-body workout system 10 includes a full-body workout strap 12, cooler 14, and one or more drink bottles 16 releasably attached thereto. FIG. 1B is a perspective view of an exemplary embodiment of the portable full-body workout system 10 shown carried by the user using the cooler handle 18 according to the present disclosure. The full-body workout strap 12 may be slung across the user's chest and attached or latched at the ends. Details of the fastening mechanism of the full-body workout strap 12 are described below. The cooler 14 may be used to store lunch, a picnic, ice pack, and other items. One or more drink bottles 16 are preferably thermally insulated and may be used to store water and other beverages. The contents of the cooler 14 and drink bottles 16 provide the weight for resistance training. Further, the cooler 14 and drink bottles 16 may incorporate additional weighted materials such as sand in the bottom portions of each component for added stability.

Figures 2A, 2B, 2C:
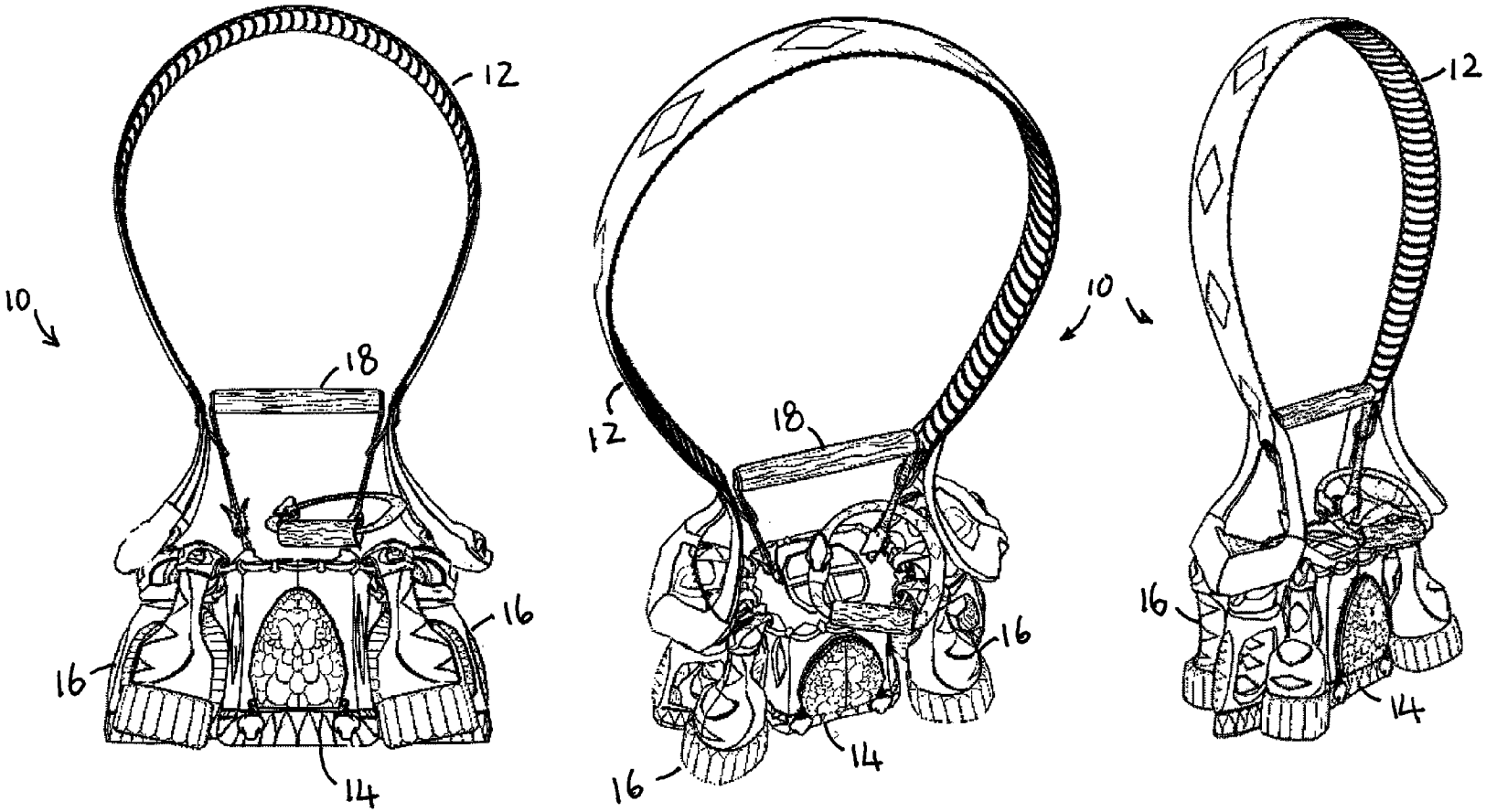
FIGS. 2A-2C are front and perspective views of an exemplary embodiment of a portable full-body workout system according to the present disclosure.

FIGS. 2A-2C are front and perspective more detailed views of an exemplary embodiment of a portable full-body workout system 10 showing the components of the system: full-body workout strap 12, cooler 14, drink bottles 16, and cooler handle 18. The portable full-body workout system 10 can be easily carried on hikes and walks, and can be used virtually anywhere for instant workout and resistance training. The user may perform all the moves while walking forward to add an aerobic component to the exercise.

FIG. 3 is front view of an exemplary embodiment of a portable full-body workout system 10 showing all of the components detached from one another according to the present disclosure. The full-body workout strap 12 may be easily attached and detached from the cooler 14. The cooler handle 18 can be easily attached and detached from the cooler 14. An additional cooler handle 18' of the same length or different length can also be included that can be easily attached and detached from the cooler 14. A plurality of drink bottles 16 that serve to store water or beverages as well as weights can be easily attached and detached from the cooler 14. The drink bottles 16 may have different configurations to facilitate different types of workout and moves. The drink bottles include "sword" bottles 16', "dumbbell" bottles 16", and knuckle bottles 16". Details of these drink bottles are provided below.

Figure 4A:
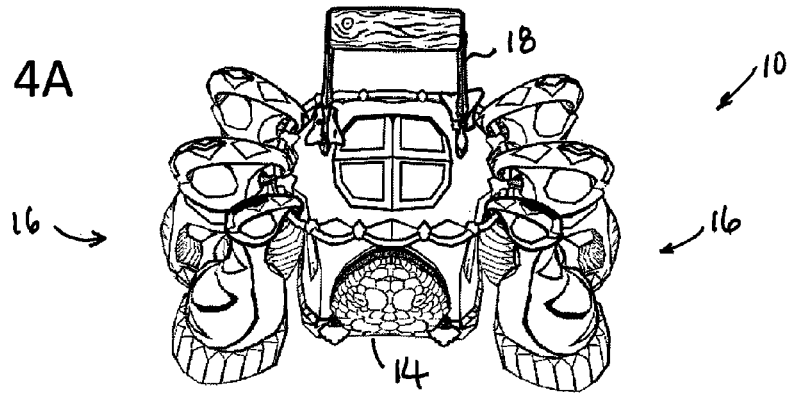
FIGS. 4A and 4B are top perspective views of an exemplary embodiment of a portable full-body workout system showing the cooler with the drink bottles attached configuration according to the present disclosure.
Figure 4B:
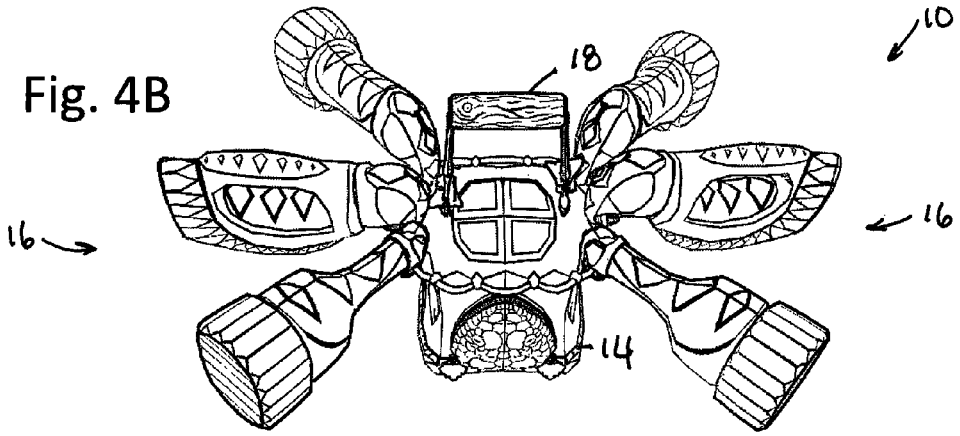
Figure 4C:
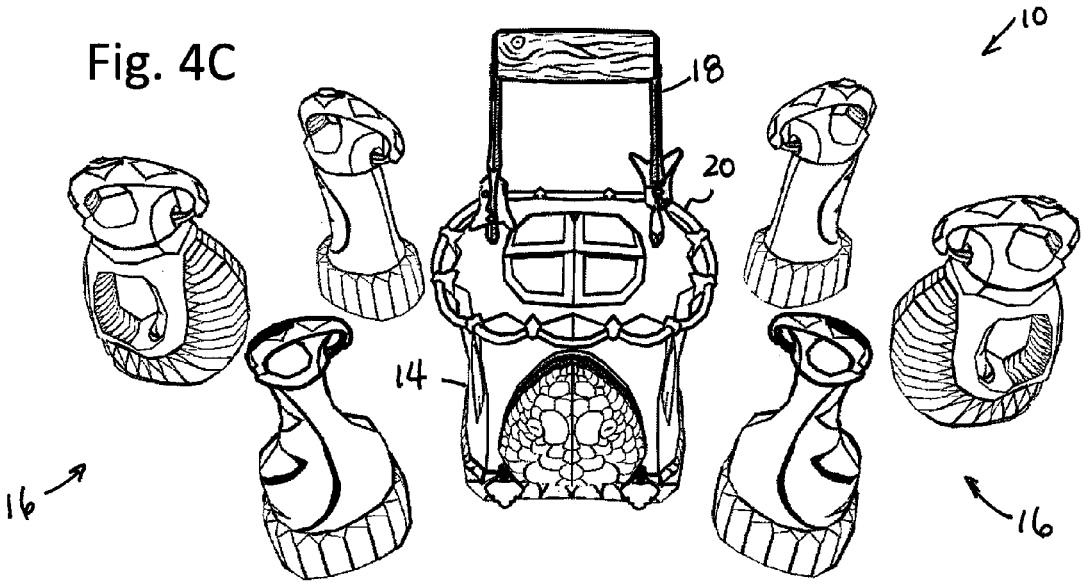
FIG. 4C is a perspective view of an exemplary embodiment of a portable full-body workout system showing the cooler with the drink bottles detached according to the present disclosure.

FIGS. 4A and 4B are top perspective views of an exemplary embodiment of a portable full-body workout system 10 showing the cooler 14 with the drink bottles 16 and cooler handle 18 attached, and FIG. 4C is a perspective view of an exemplary embodiment of a portable full-body workout system 10 showing the cooler 14 with the drink bottles 16 detached. The cooler 14 may be a soft-sided cooler that includes an inner constructed from PVC that is generally soft and flexible but can still maintain its shape. Alternatively, the cooler 14 may include an inner shell that is rigid constructed from plastic or other suitable materials. The cooler 14 may further include one or more layers of materials to provide thermal insulation, and an outer nylon or canvas exterior layer that incorporate a snake motif. A sturdy and rigid ring 20 is attached to the top edge of the cooler 14 that provides attachment points for the drink bottles 16. Alternatively, multiple rigid hoops made from metal or plastic may be fastened to the top edge of the cooler 14 as attachment points. In yet another alternate embodiment, a sturdy flexible cord may be secured to the top edge of the cooler 14 at various points and be provided as anchor points for the drink bottles 16. As provided above, the cooler handle 18 can be easily attached and detached from the cooler 14.

Figure 5A:
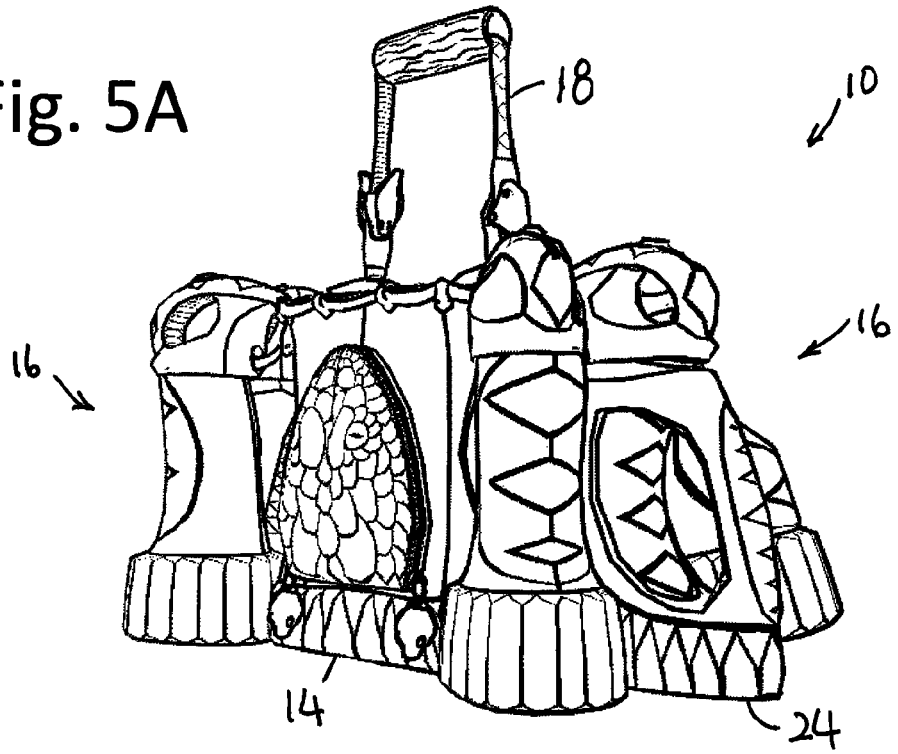
FIGS. 5A and 5B are front and bottom perspective views of an exemplary embodiment of a portable full-body workout system showing the cooler with the drink bottles attached configuration according to the present disclosure.
Figure 5B:
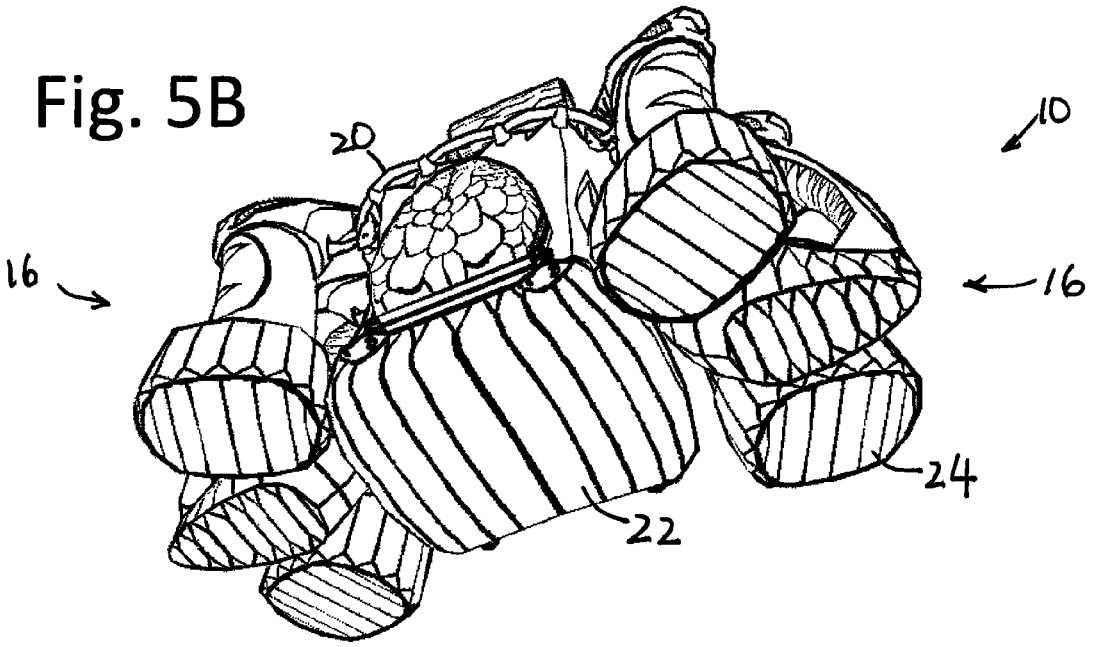

FIGS. 5A and 5B are front and bottom perspective views of an exemplary embodiment of a portable full-body workout system 10 showing the cooler 14 with the drink bottles 16 attached configuration according to the present disclosure. As described above, the cooler handle 18 can be easily attached and detached from the cooler 14, and a sturdy ring 20 is attached to the top edge of the cooler 14 that provides attachment points for the drink bottles 16. The cooler 14 includes a bottom portion 22 with a non-slip surface that is preferably rubberized with a tread pattern that is reminiscent of a reptile belly. The bottom portion 22 is preferably padded that provides shock-absorption. In an embodiment of the cooler, the bottom portion 22 may incorporate a separate compartment for storing additional materials for added weight, such as sand or sand bags that may be added or subtracted by the user. The bottom portion 24 of the drink bottles 16 also incorporates a non-slip rubberized surface with a reptile scale design and can be constructed in a similar manner. The drink bottles 16 may also include a separate bottom compartment to store sand or sand bags that can be added or removed. The weighted and wider stance of the cooler and drink bottle combination enable the system to sit upright even on uneven surfaces.

Figures 6A, 6B, 6C:
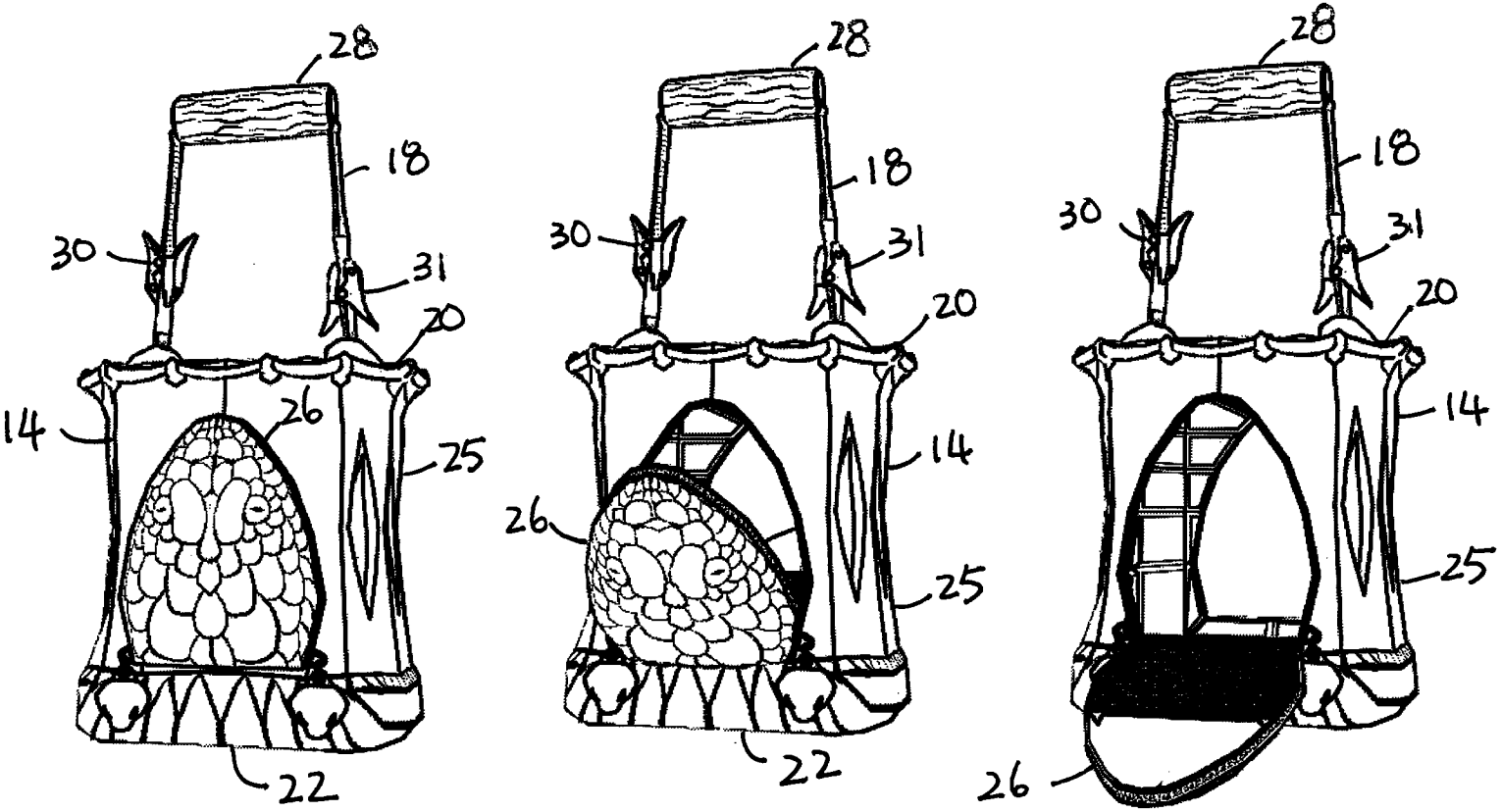
FIGS. 6A-6C are front perspective views of an exemplary embodiment of a portable full-body workout system showing more details of the cooler according to the present disclosure.
Figures 7A, 7B, 7C, 7D:
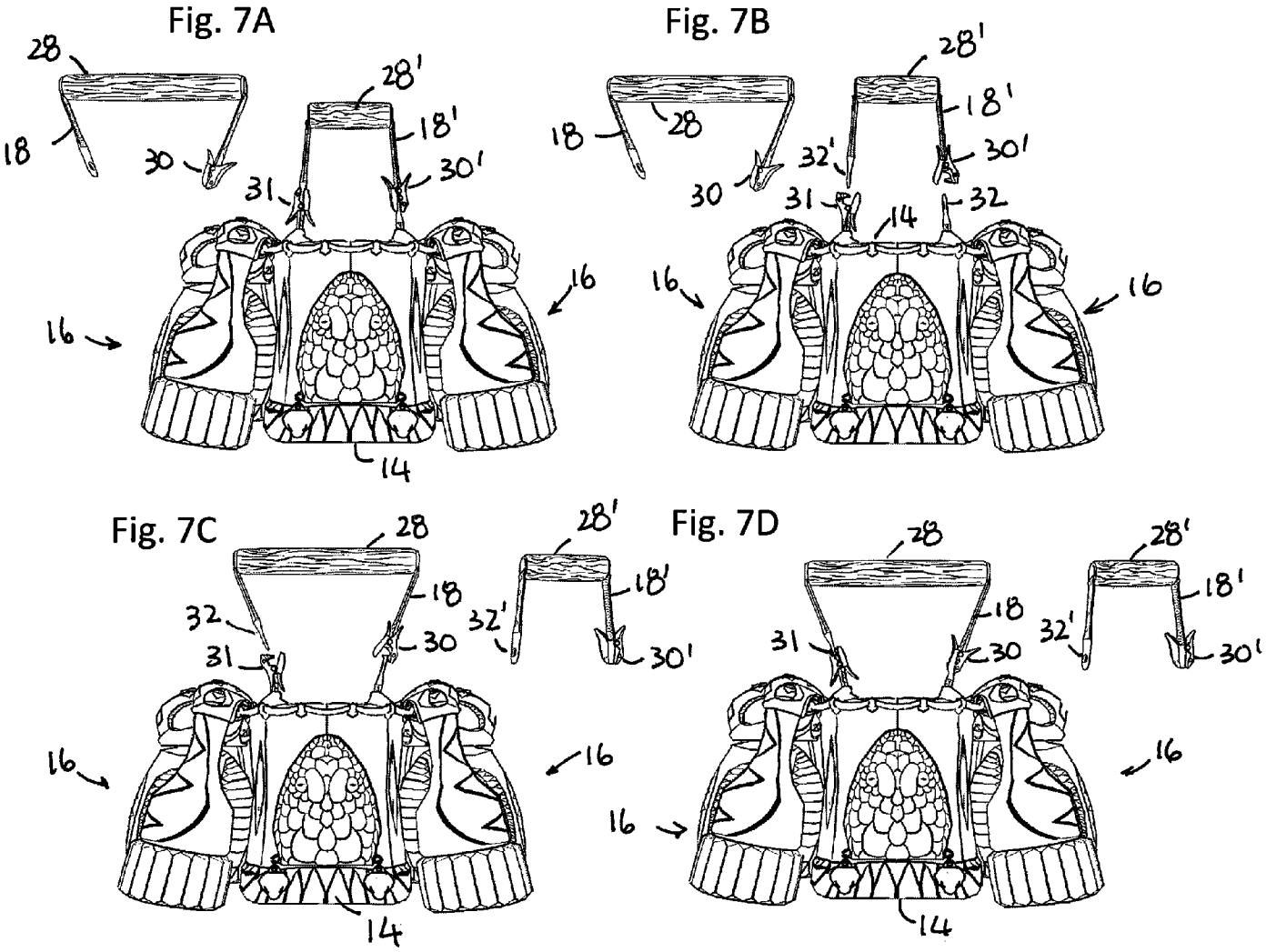
FIGS. 7A-7D are front views of an exemplary embodiment of a portable full-body workout system showing the cooler with various lengths of handle strap attached and detached according to the present disclosure.

FIGS. 6A-6C are front perspective views of an exemplary embodiment of a portable full-body workout system 10 showing more details of the cooler 14 according to the present disclosure. The cooler 14 includes a body 25 that define an inner compartment accessible by an opening covered by a hinged lid 26 preferably formed in a side wall of the cooler. A second hinged lid (not shown) may be disposed on the opposed side of the cooler 14 to provide access from the other side of the cooler. The cooler compartment is insulated by walls (including the hinged lids 26) that have thermal insulation properties. It may be seen that a design element of the lid 26 includes a snake head with an intricate scale pattern. The lid 26 is preferably closed over the opening by a fastener such as a zipper but other suitable forms of closure may be used, such as hook and loop fasteners, for example. As described above, the cooler 14 preferably includes a weighted bottom portion 22 that may include a separate compartment to hold sand or sand bags, for example. The bottom portion 22 preferably includes a non-slip surface with a tread pattern. The cooler 14 further includes a handle 18 equipped with a handle bar 28. The cooler handle 18 is releasably attached to the cooler 14 by fasteners or clips 30 and 31, where the clip 30 is part of the handle 18, and clip 31 is part of the cooler 14. As described above, a sturdy ring 20 is attached to the top edge of the cooler 14 that provides attachment points for the drink bottles 16.

FIGS. 7A-7D are front views of an exemplary embodiment of a portable full-body workout system 10 showing the cooler 14 (shown with drink bottles 16 attached) with two different lengths of handle straps 18 and 18' attached and detached according to the present disclosure. The cooler handles 18 and 18' may be interchanged to vary the length and handle bar sizes. The handles 18 and 18' may vary in the diameter and length of the handle bars 28 and 28', as well as the length of the handle itself. The handles 18 and 18' include handle bars 28 and 28', and a clip fastener 30 and 30' for attaching to a ring or loop 32 located on the cooler 14. At a second end of the cooler handles 18 and 18' is a ring or loop 32 and 32' to enable a clip fastener 31 on the cooler 14 to attach thereto. The clip fasteners 30, 30', 31, and 31' preferably bear a snake head design as shown.

Figure 8A:
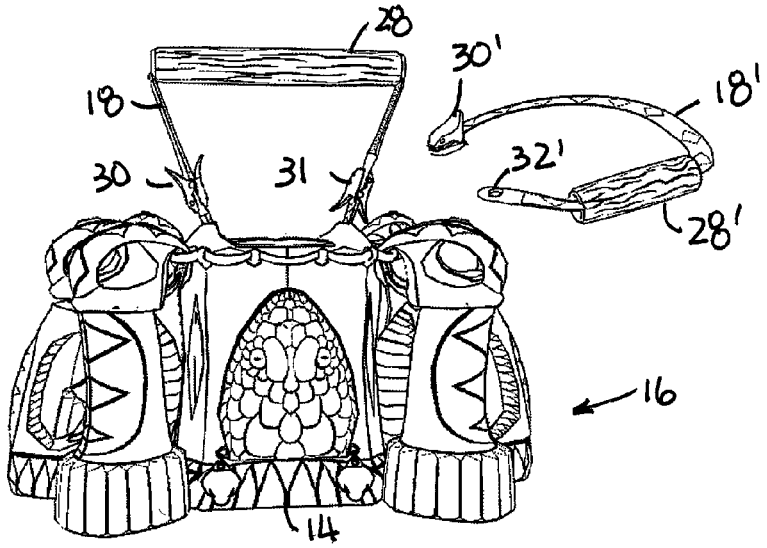
FIGS. 8A-8C are front views of an exemplary embodiment of a portable full-body workout system showing the cooler with a second handle strap attached configuration according to the present disclosure.
Figure 8B:
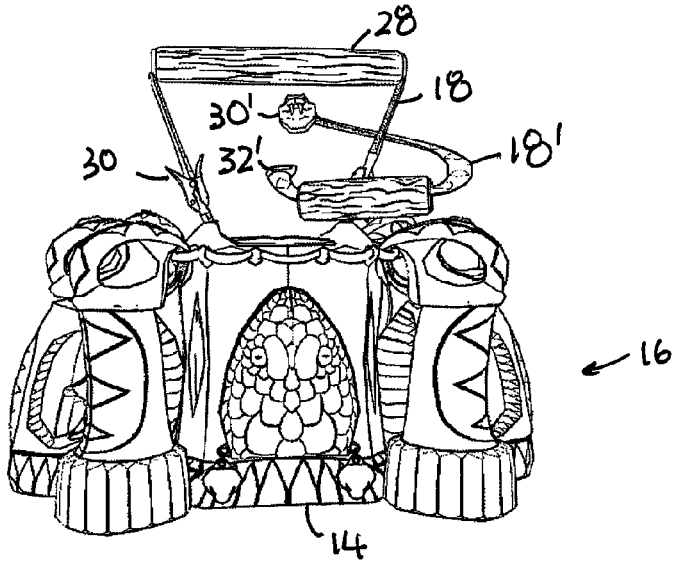
Figure 8C:
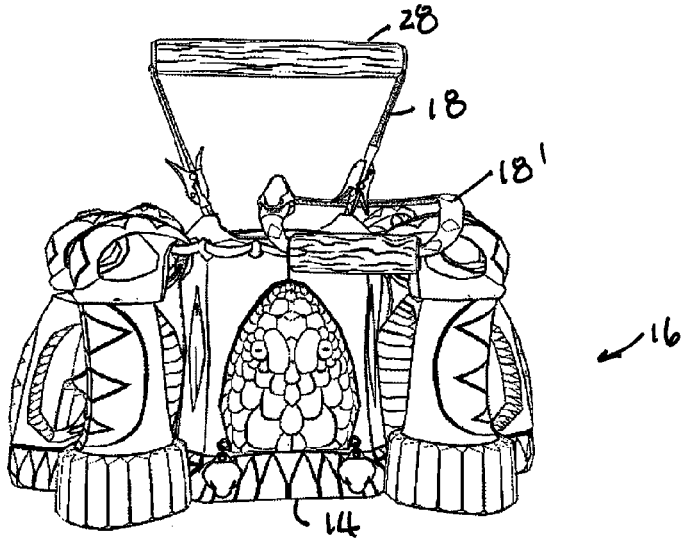

FIGS. 8A-8C are front views of an exemplary embodiment of a portable full-body workout system 10 showing the cooler 14 (shown with drink bottles 16 attached) with a second handle strap 18' attached according to the present disclosure. These figures show how one or more additional handle straps 18' may be easily detachably attached to the cooler 14 for later use. As described above, the handles 18 and 18' may vary in the diameter and length of the handle bars 28 and 28', as well as the length of the handle itself. The handles 18 and 18' include handle bars 28 and 28', and a clip fastener 30 and 30' for attaching to a ring or loop 32 located on the cooler 14.

Figure 9A:
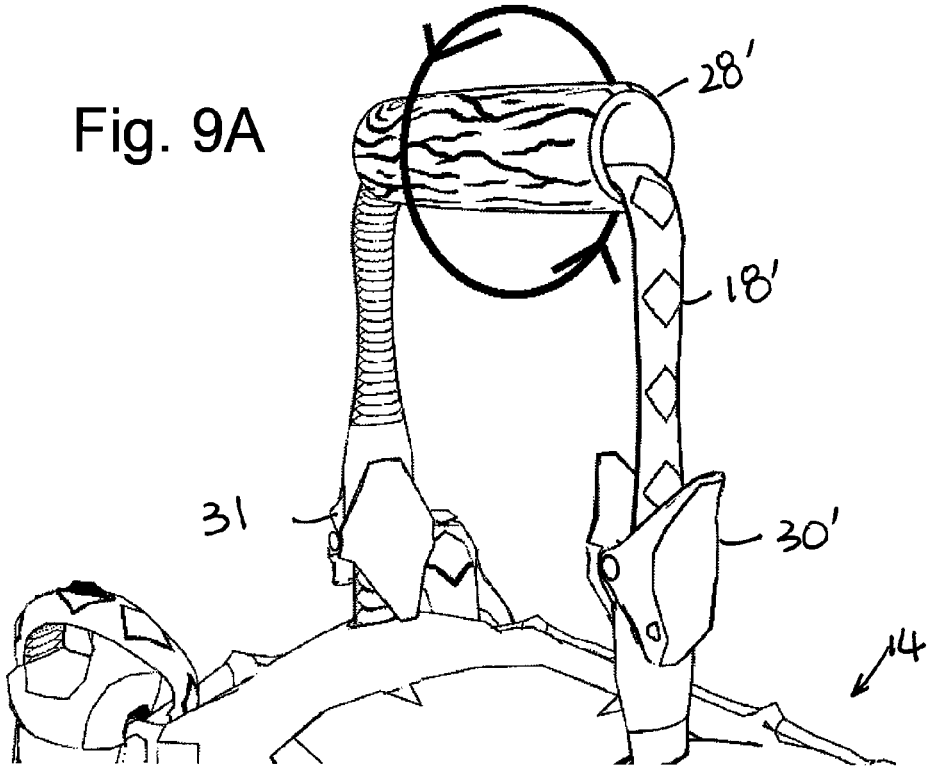
FIGS. 9A and 9B are partial views of an exemplary embodiment of a portable full-body workout system showing a detail of the cooler handle strap according to the present disclosure.
Figure 9B:
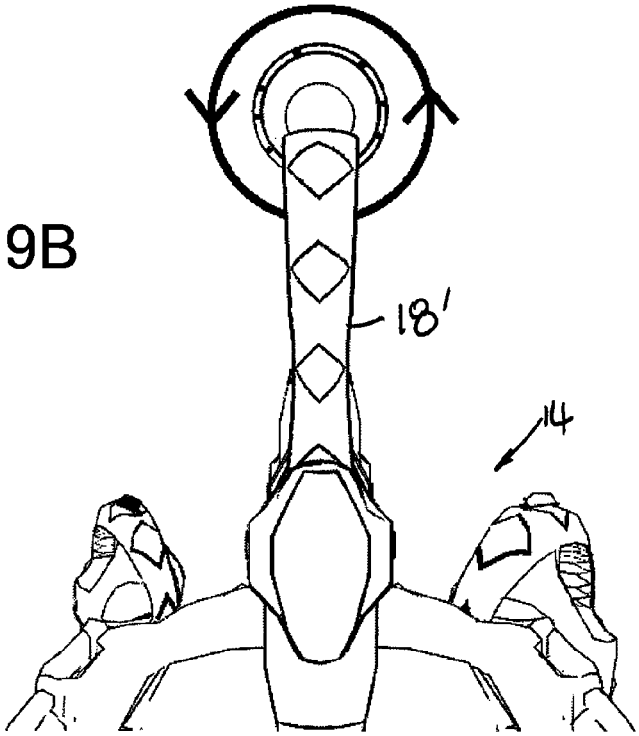

FIGS. 9A and 9B are partial views of an exemplary embodiment of a portable full-body workout system showing a detail of the cooler handle 18' according to the present disclosure. The cooler handle 18' comprises a generally cylindrical handle bar 28' that may freely rotate about the handle 18'. The rotatable handle bars 28' facilitates some of the workout moves described below using the cooler 14 as a weight. The cooler handles 18 and 18' are equipped with rotatable handle bars 28 and 28'. The handle 18 is preferably constructed of a sturdy nylon cord or other suitable materials, and the handle bar 28 is preferably constructed of a durable plastic or rubberized material that provides a cushioned and comfortable grip. As described above, the handles 18 and 18' may vary in the diameter and length of the handle bars 28 and 28', as well as the length of the handle itself. The handles 18 and 18' include handle bars 28 and 28', and a clip fastener 30 and 30' for attaching to a ring or loop located on the cooler 14.

Figure 10A:
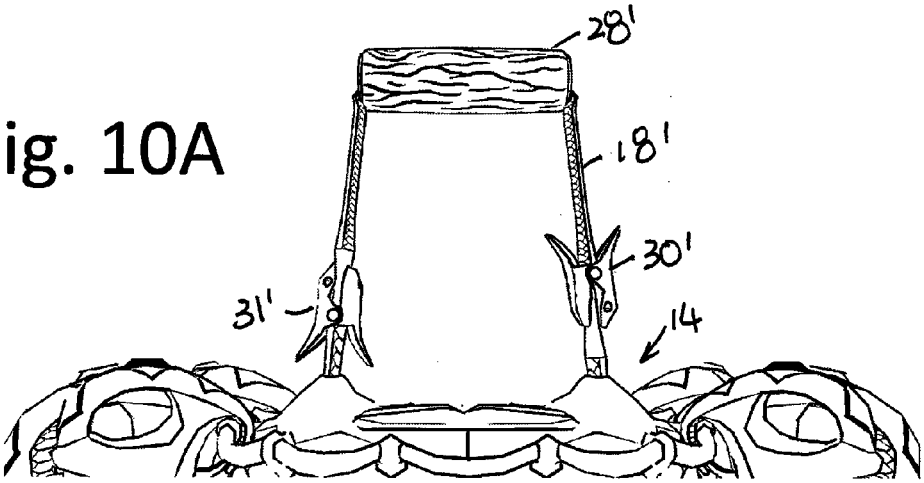
FIGS. 10A-10C are partial views of an exemplary embodiment of a portable full-body workout system showing details of the cooler handle strap fastener according to the present disclosure.
Figure 10B:
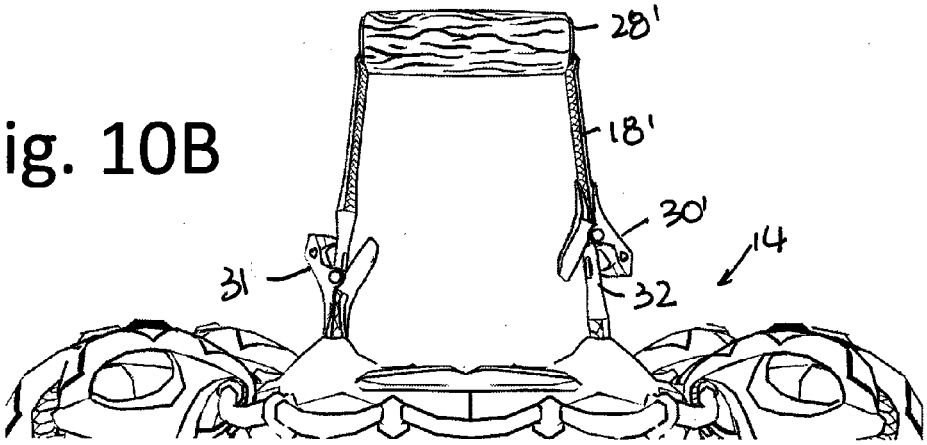
Figure 10C:
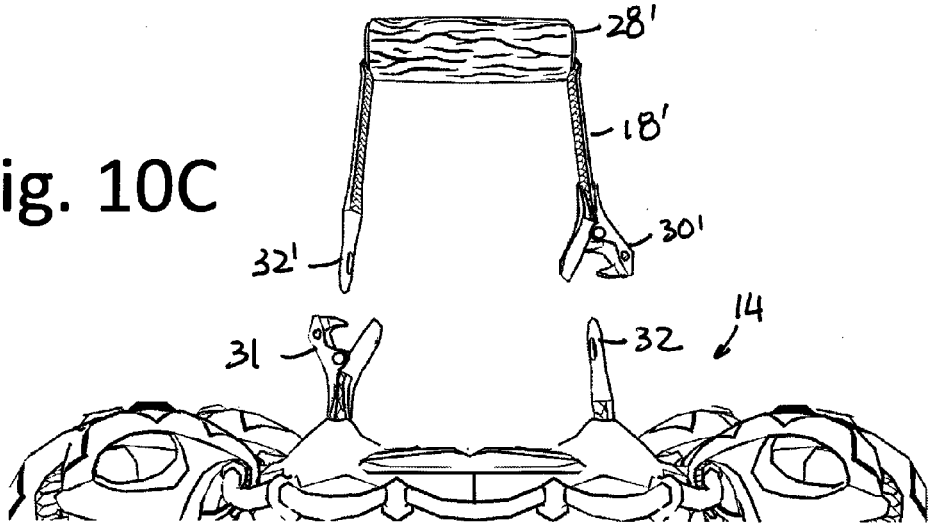

FIGS. 10A-10C are partial views of an exemplary embodiment of a portable full-body workout system 10 showing more details of the cooler handle 18' and the clip fastener 30' according to the present disclosure. The cooler handle 18' comprises a generally cylindrical handle bar 28' that may freely rotate about the handle 18'. The cooler handle 18' includes a clip fastener 30' at one end that may clip onto a ring 32 on the cooler 14, and a loop 32' at the other end of the cooler handle 18' that may be clipped onto by a clip fastener 31 on the cooler 14. The clip fasteners 30' of the cooler handle 18' and clip fastener 31 of the cooler preferably bear a snake head design as shown.

Figure 11A:
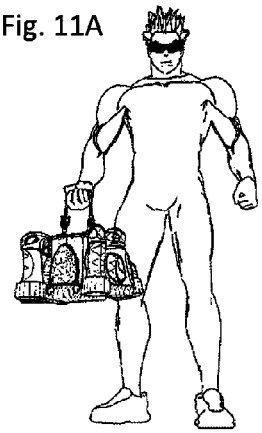
FIGS. 11A-11I and 12A-12F are various views of the various ways that a user may obtain a full-body workout using the cooler with drink bottles attached configuration with the handle strap attachment according to the present disclosure.
Figure 11B:
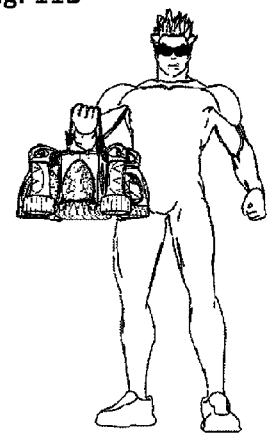
Figure 11C:
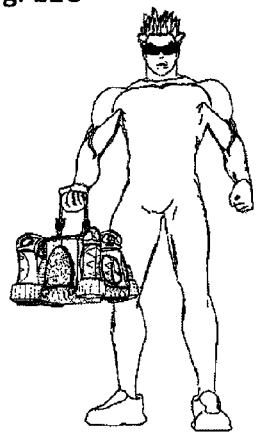
Figure 11D:
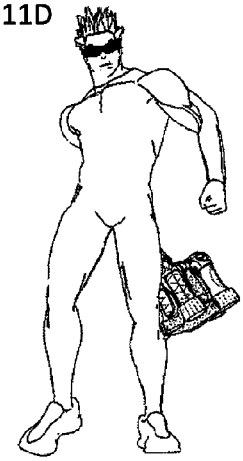
Figure 11E:
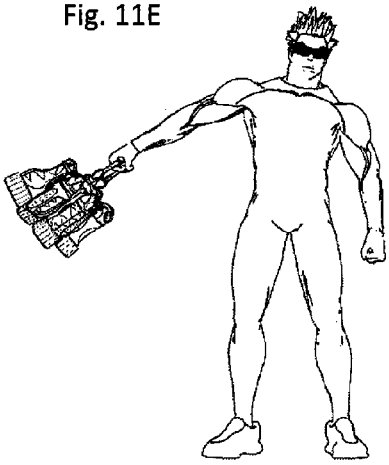
Figure 11F:
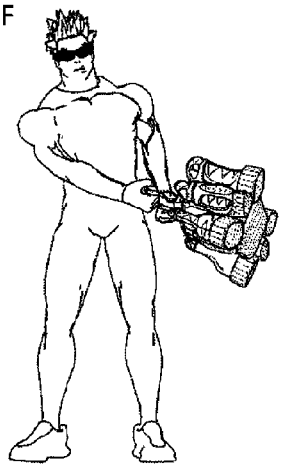
Figure 11G:
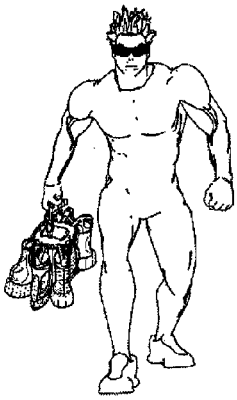
Figure 11H:
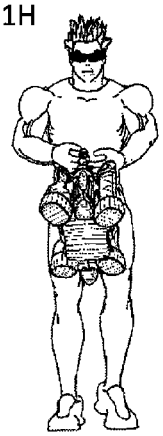
Figure 11I:
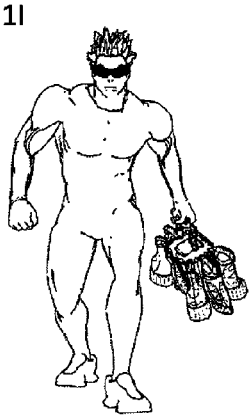
Figure 12A:
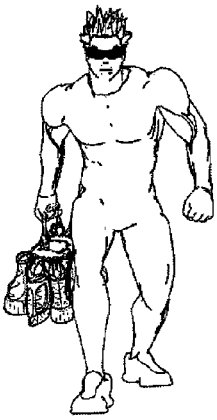
Figure 12B:
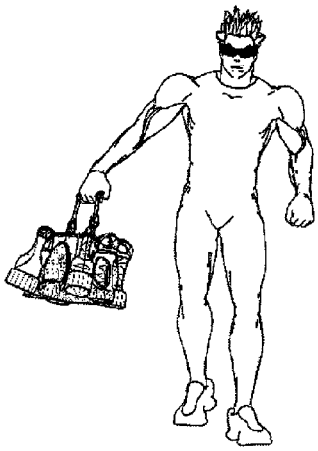
Figure 12C:
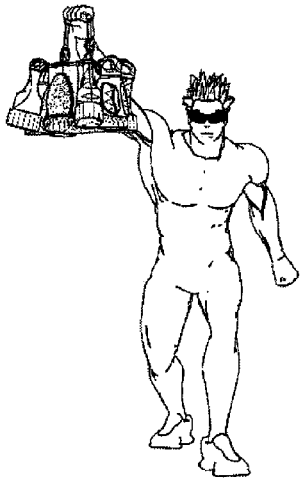
Figure 12D:
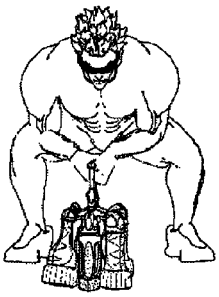
Figure 12E:
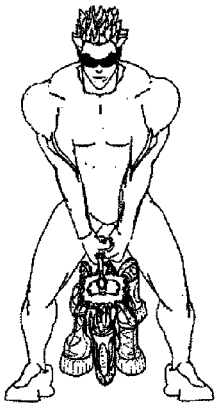
Figure 12F:
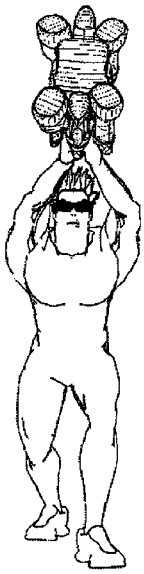
Figure 14A:
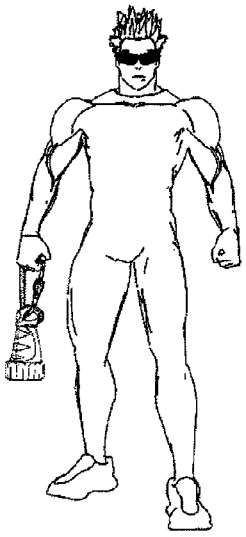
FIGS. 14A-14F are various views of the various ways that a user may obtain a full-body workout using the drink bottles with a cooler handle strap configuration according to the present disclosure.
Figure 14B:
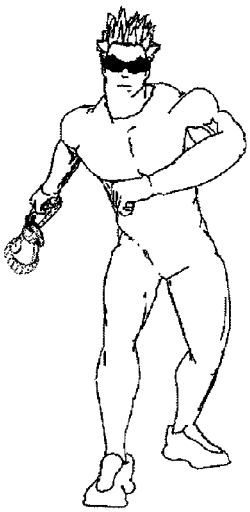
Figure 14C:
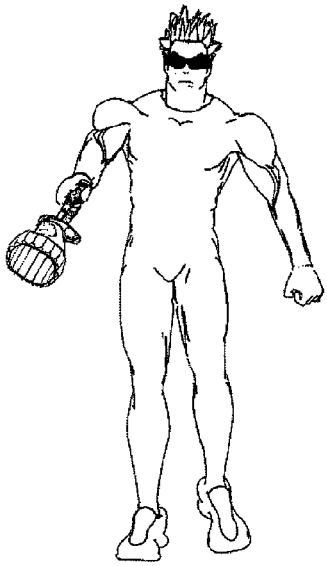
Figure 14D:
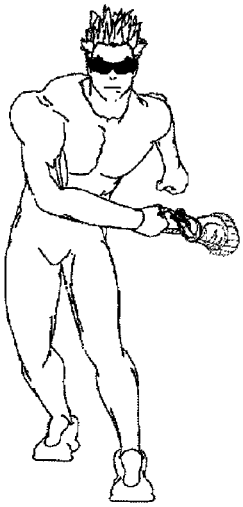
Figure 14E:
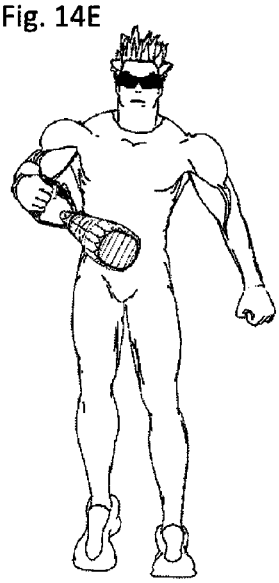
Figure 14F:
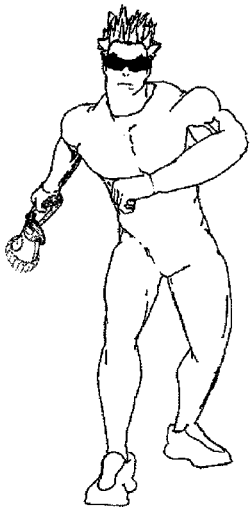

FIGS. 11A-11I and 12A-12F are various views of the various ways that a user may obtain a full-body workout using the cooler with drink bottles attached configuration with the handle strap attachment according to the present disclosure. The user may use the cooler and attached drink bottles like a conventional dumbbell and kettle bell weights. In FIGS. 11A-11C, the cooler and attached drink bottles are used like a dumbbell in a bicep curl exercise to work the bicep muscle. In FIGS. 11D-11F, the cooler and the drink bottles are used like a kettle bell. These moves strengthens the shoulders, and the core. In FIGS. 11G-11I, the cooler and attached drink bottles are passed from one hand to the other hand as the user lunge walks forward. These moves targets the leg and glut muscles as well as the muscles in the shoulders and arms. In FIGS. 12A-12C, the cooler and attached drink bottles are used in a one-handed lift as the user walks forward to target the shoulder muscles. In FIGS. 12D-12F, the cooler and attached drink bottles are used in the kettle bell squats and lifts. These moves target the legs, glut, and back muscles. These figures show that exemplary moves using the cooler and attached drink bottles may include curls, lifts, swings (front to back and side to side), shifting from one hand to the other hand, release and catch, etc. The swinging motion of the weight adds centrifugal force to the resistance training that further stretches the muscles and tendons.

FIGS. 13A-13C are various views of an exemplary embodiment of a drink bottle component 16 of the portable full-body workout system 10 with a cooler handle strap 18' (with handle bar 28') fastened configuration according to the present disclosure. The drink bottle (the "dumbbell" drink bottle shown as example) includes a loop configuration 34 that may receive the cooler handle strap 18', and fasten to the drink bottle 16" by clipping the fastener 30' at one end of the handle 18' to the ring 32' at the other end. Although shown with the shorter cooler handle 18', the user may also use the longer handle 18 for this workout.

FIGS. 14A-14F are various views of the various ways that a user may obtain a full-body workout using the drink bottles with a cooler handle strap configuration described above and shown in FIGS. 13A-13C according to the present disclosure. As shown, the user may swing the drink bottle weight like a kettle bell front and back and side to side to work the upper body muscles. The swinging motion of the weight adds centrifugal force to the resistance training that further stretches the muscles and tendons. The user may perform these swings while walking forward to add an aerobic component to the exercise.

Figure 15A:
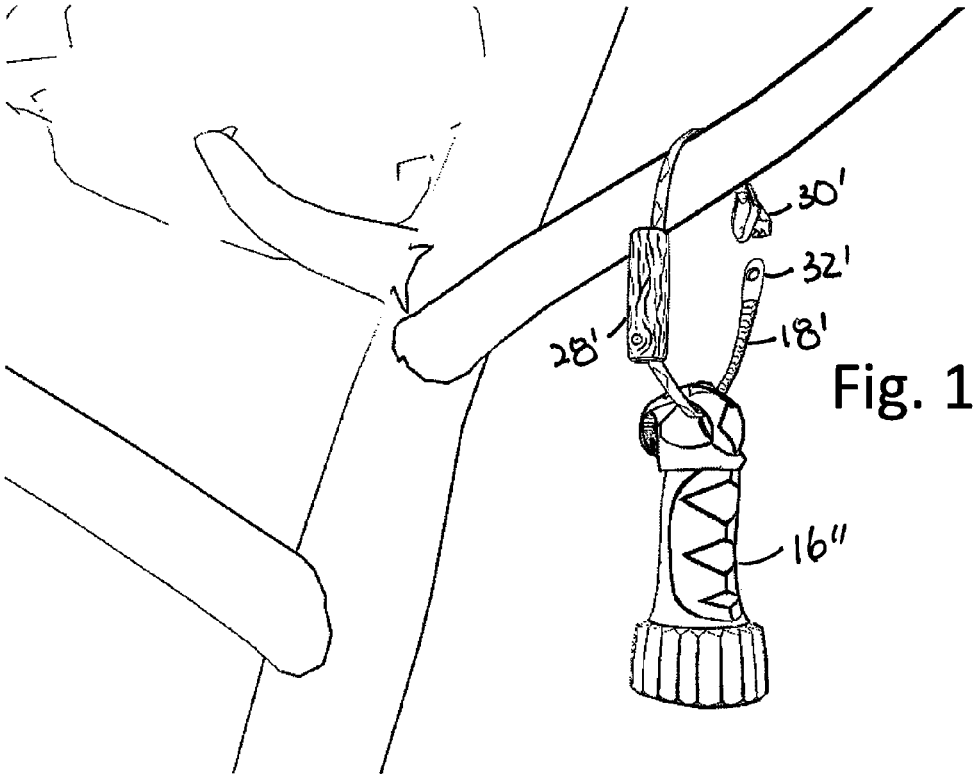
FIGS. 15A and 15B are views of an exemplary embodiment of a drink bottle component of the portable full-body workout system with a cooler handle strap fastened configuration according to the present disclosure.
Figure 15B:
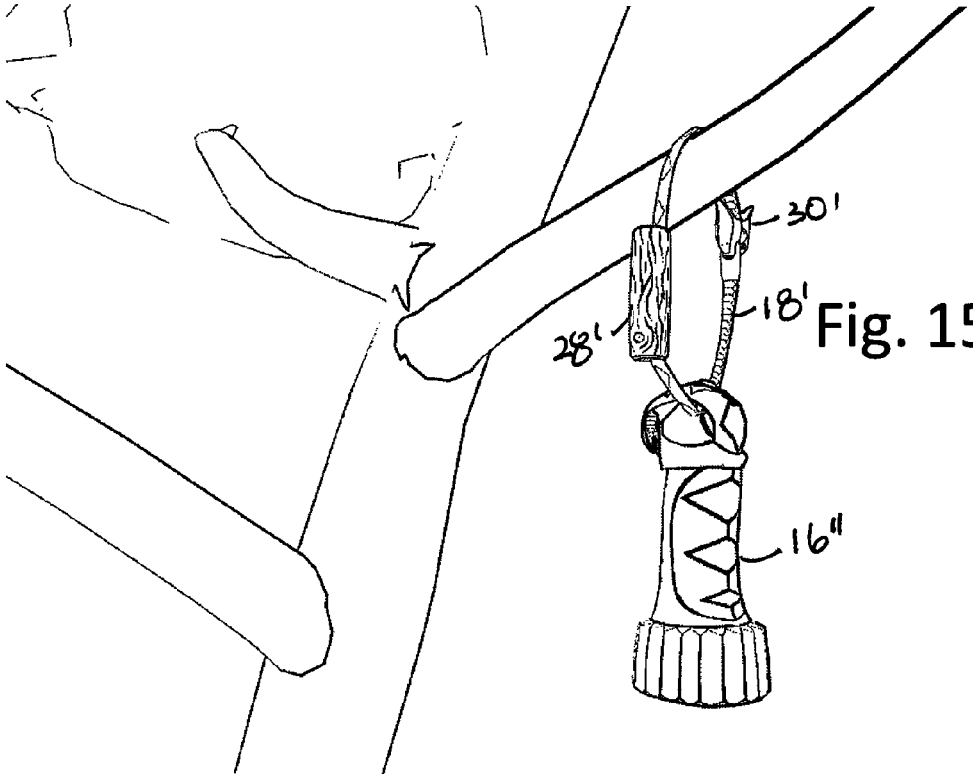

FIGS. 15A and 15B are views of an exemplary embodiment of a drink bottle component 16" of the portable full-body workout system 10 with a cooler handle strap 18' (with handle bar 28') fastened to the drink bottle 16" by clipping the fastener 30' at one end of the handle 18' to the ring 32' at the other end according to the present disclosure. The cooler handle 18' may be used to secure the drink bottle 16" (the "dumbbell" drink bottle shown as example) to a tree, post, or another structure to keep it off the ground while not in use. This is especially nice when the ground is muddy or dirty.

Figure 16A:
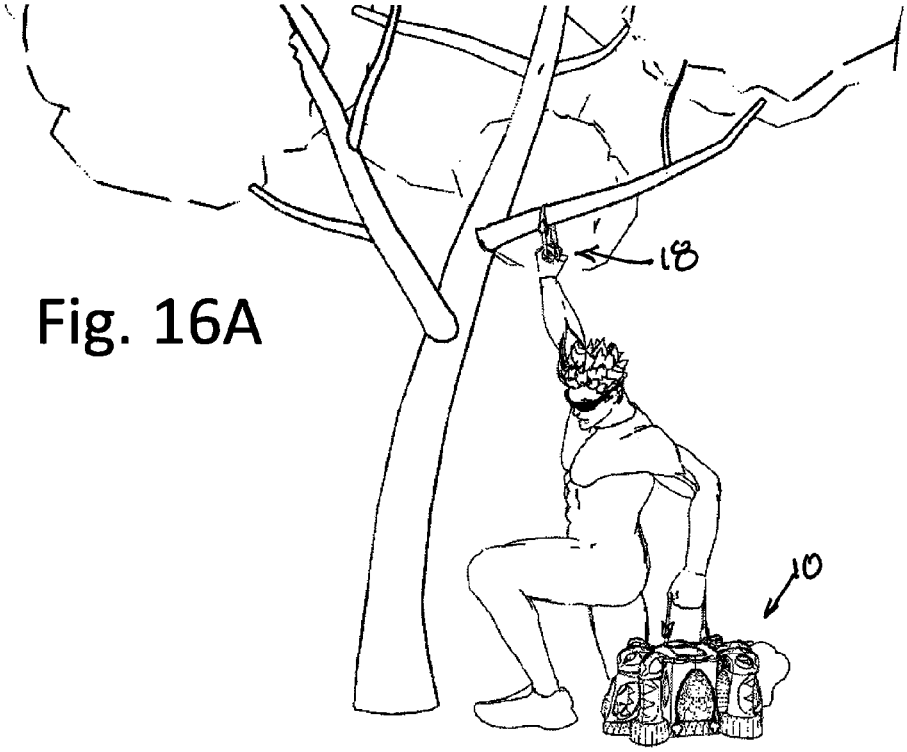
FIGS. 16A and 16B are views of the various ways that a user may obtain a full-body workout using the cooler with drink bottles attached configuration with a cooler handle strap fastened to an immobile object according to the present disclosure.
Figure 16B:
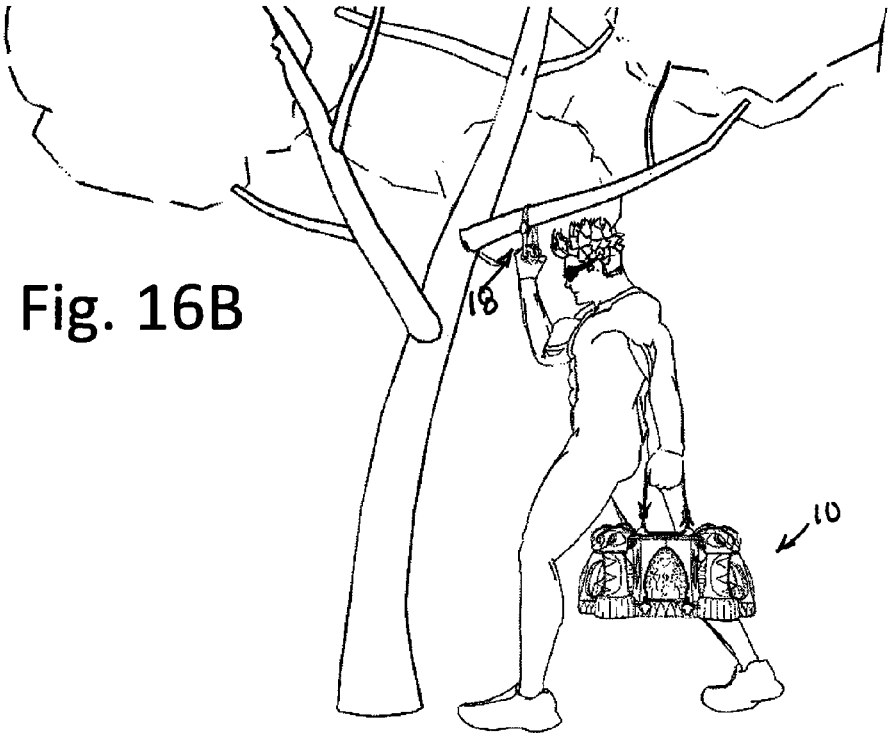
Figure 17A:
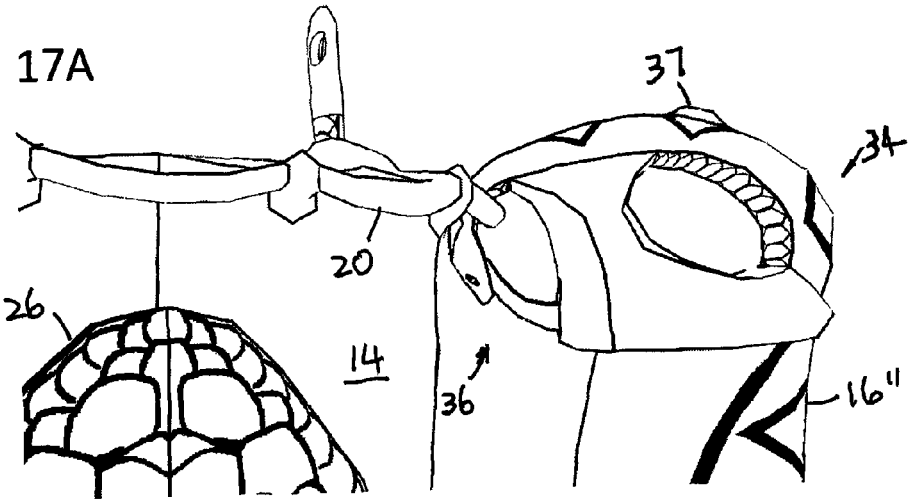
FIGS. 17A-18C are various views of an exemplary embodiment of a drink bottle component of the portable full-body workout system attaching and detaching from the cooler according to the present disclosure.
Figure 17B:
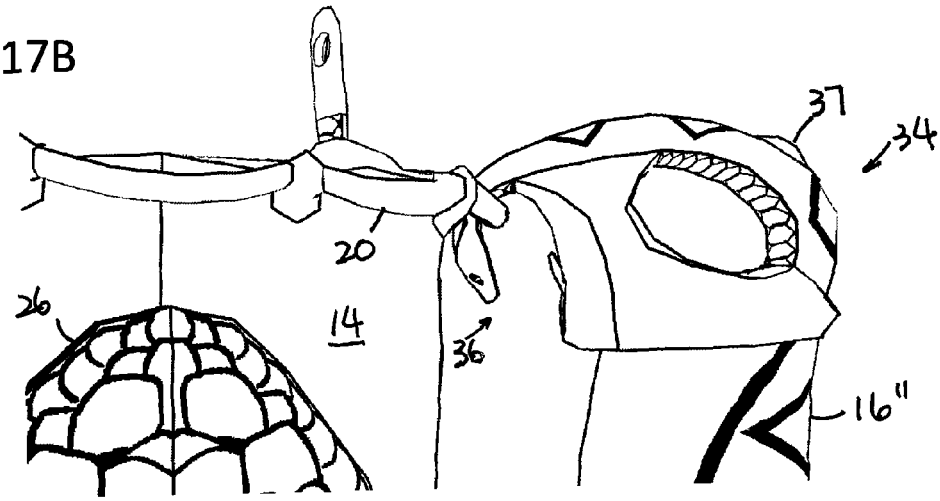
Figure 17C:
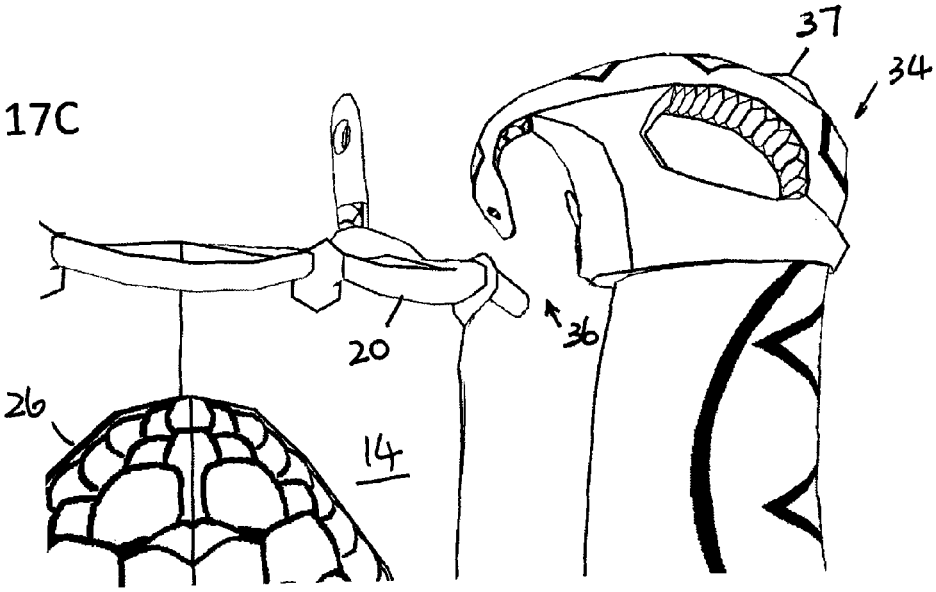
Figure 18A:
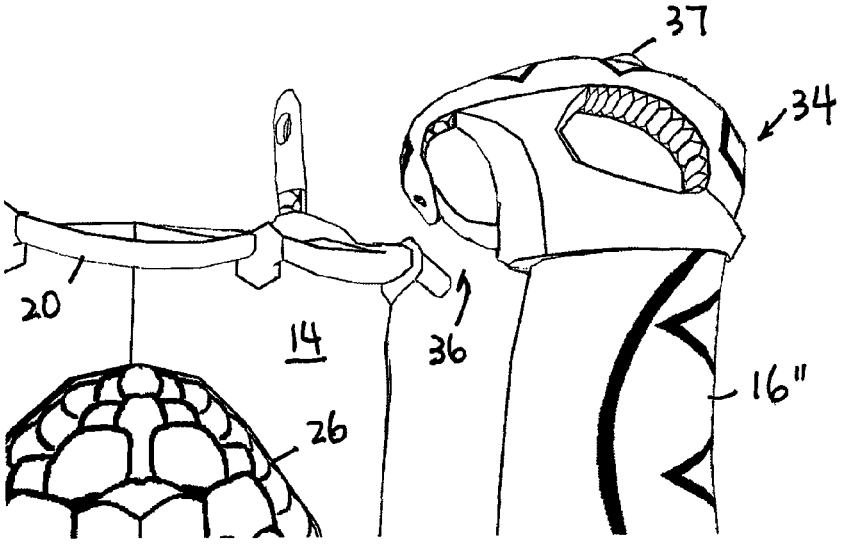
Figure 18B:
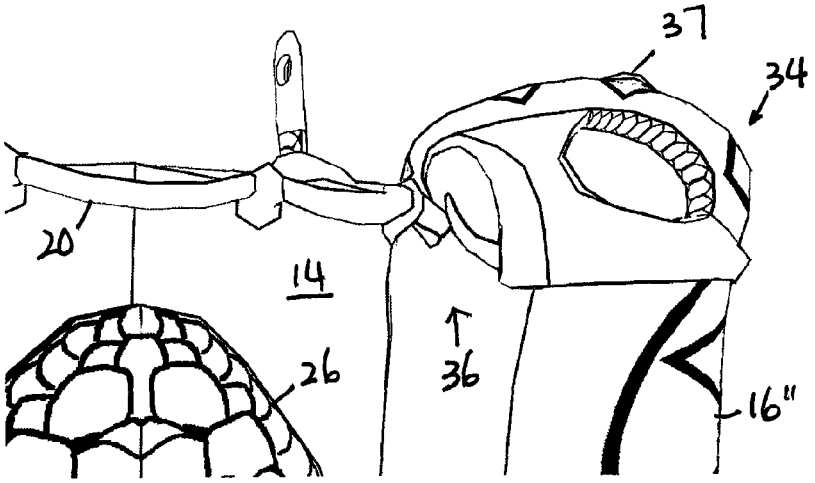
Figure 18C:
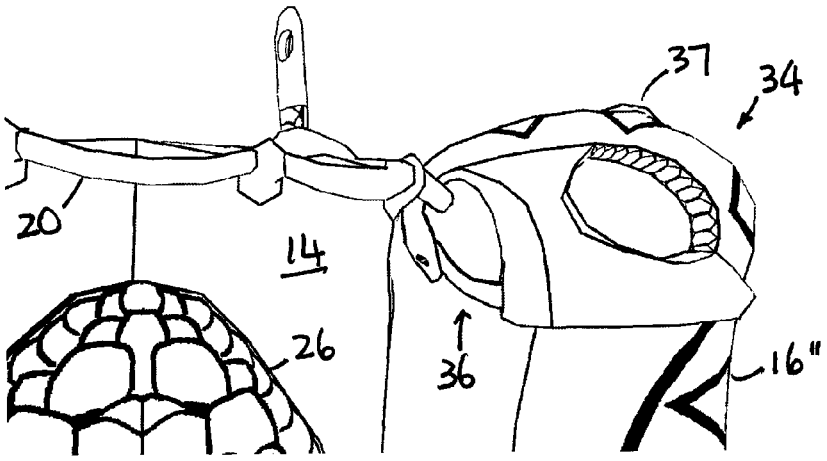
Figure 19A:
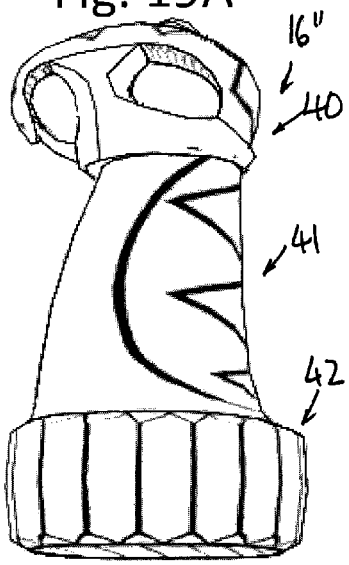
FIGS. 19A-19F are side views of various exemplary embodiments of a "dumbbell" drink bottle component of the portable full-body workout system according to the present disclosure.
Figure 19B:
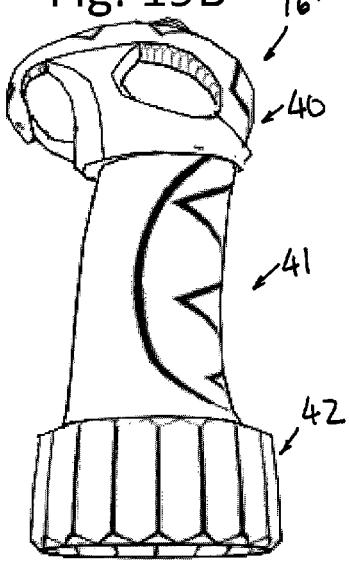
Figure 19C:
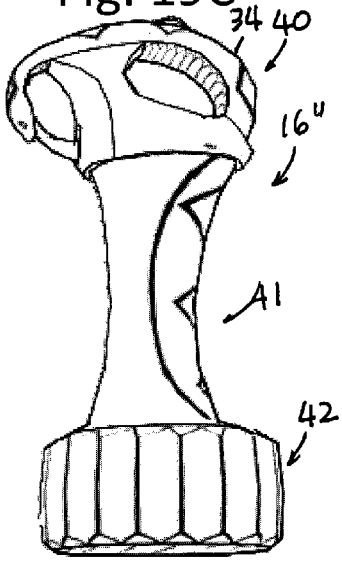
Figure 19D:
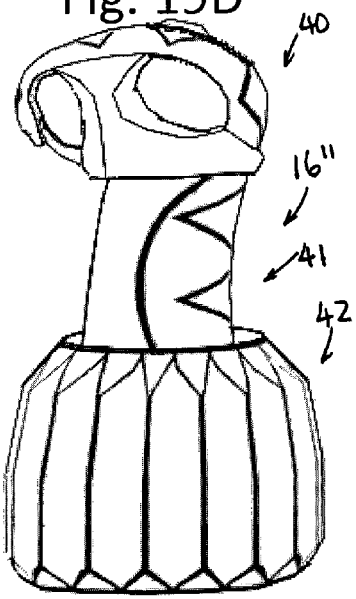
Figure 19E:
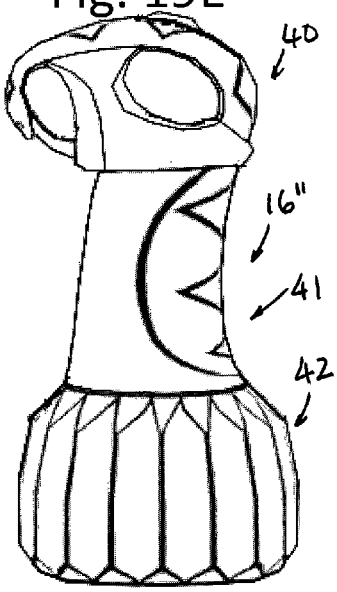
Figure 19F:
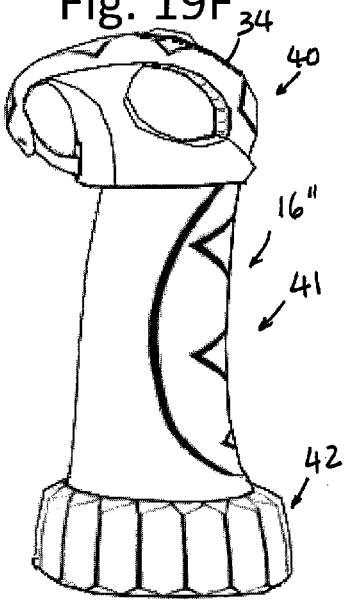
Figure 20A:
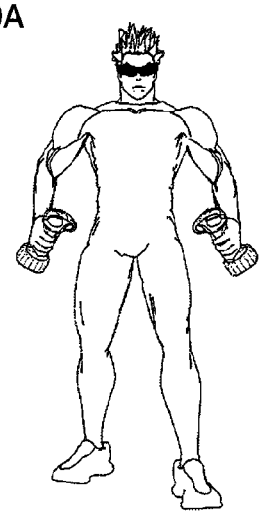
FIGS. 20A-20F are views of the various ways that a user may workout using the drink bottles according to the present disclosure.
Figure 20B:
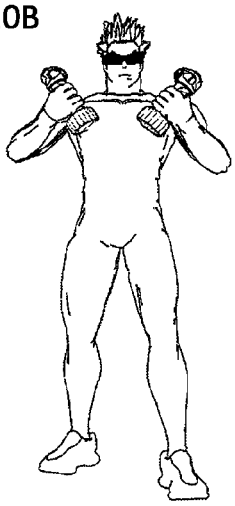
Figure 20C:
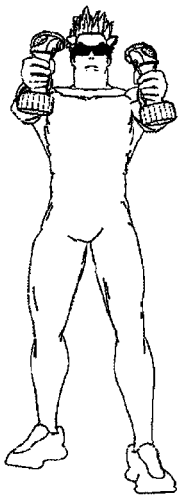
Figure 20D:
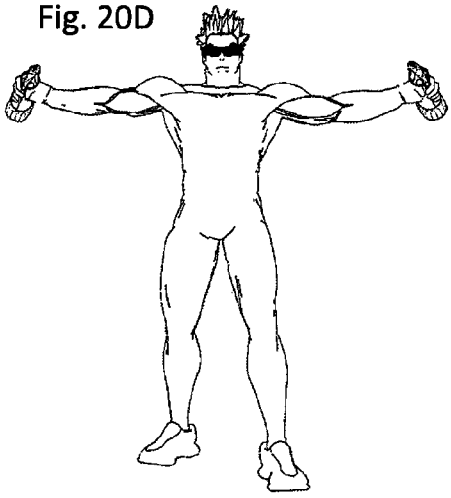
Figure 20E:
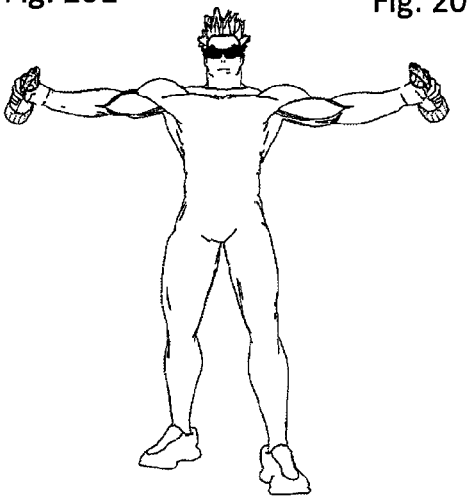
Figure 20F:
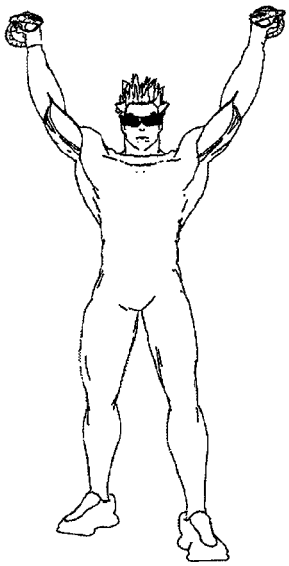

FIGS. 16A and 16B are views of the various ways that a user may obtain a full-body workout using the system 10 with cooler and drink bottles attached configuration with a cooler handle strap 18 fastened to an immobile object according to the present disclosure. The cooler handle 18 can be secured to a tree or another structure and the user may perform pull-up type exercises using the cooler handle in one hand and the cooler and drink bottles in the other hand. The user can work his entire body using these moves.

FIGS. 17A-18C are various more detailed views of an exemplary embodiment of a drink bottle component 16" of the portable full-body workout system detaching from and attaching to the cooler 14 according to the present disclosure. Each drink bottle 16" is equipped with a loop configuration 34 and quick-release latch 36 that may be operated with a button or slide 37. As described above, a sturdy ring 20 is attached to the top edge of the cooler 14 (showing the hinged lid 26) that provides attachment points for the drink bottles 16". For example, pressing the button 37 causes the latching mechanism to open and releasing the button 37 causes the latching mechanism to close. Alternatively, the quick-release latch 36 may operate much like a spring-loaded carabiner that does not require a button or slide 37 for its operations. The quick lease latch 36 may bear a snake head design as shown in the figures.

FIGS. 19A-19F are side views of various exemplary embodiments of a "dumbbell" drink bottle component 16" of the portable full-body workout system 10 according to the present disclosure. The "dumbbell" drink bottles 16" comprise a lid or top 40 that includes the loop configuration 34 and quick-release latch mechanism 36. The top 40 may be a hinged flip-top or may be unattached to the body 41 of the drink bottle. The top 40 and the top edge of the body 41 may include matching threads that enable the top 40 to screw onto the drink bottle and form a water-tight seal. The body 41 of the drink bottle 16" may include a stainless steel or plastic bottle with one or more thermal insulative outside layers to keep the drink contained inside the bottle temperature stable. The exterior of the body 41 may include a textured or rubberized surface to provide a cushioned non-slip grip for the user. The drink bottle body 41 is generally cylindrical with a diameter and configuration that may vary slightly, as shown in FIGS. 19A-19F, for users with different size hands and preferences. The drink bottle further includes a weighted bottom portion 42. The size (thickness and/or diameter) and configuration of the bottom portion 42 may vary to provide varying amounts of weight. The bottom portion 42 of the drink bottle 16" includes a rubberized textured surface. A separate weight compartment that stores sand or sand bags may be formed in the bottom portion 42. The weight compartment may be a zippered compartment that is accessible by the user to adjust the amount of sand or the number of sand bags. Of course, the weight of the drink bottles are also adjustable dependent on the amount of water or beverage in the bottles. The weight of the bottom portion 42 provides added stability to the drink bottles so that they do not tip over easily even on bumpy or angled surfaces.

FIGS. 20A-20F are views of the various ways that a user may workout using the "dumbbell" drink bottles according to the present disclosure. The "dumbbell" drink bottles may be used in a variety of ways to strengthen the shoulder and arm muscles, including curls, lateral raises, shoulder presses, upright rows, front raises, etc.

Figure 21B:
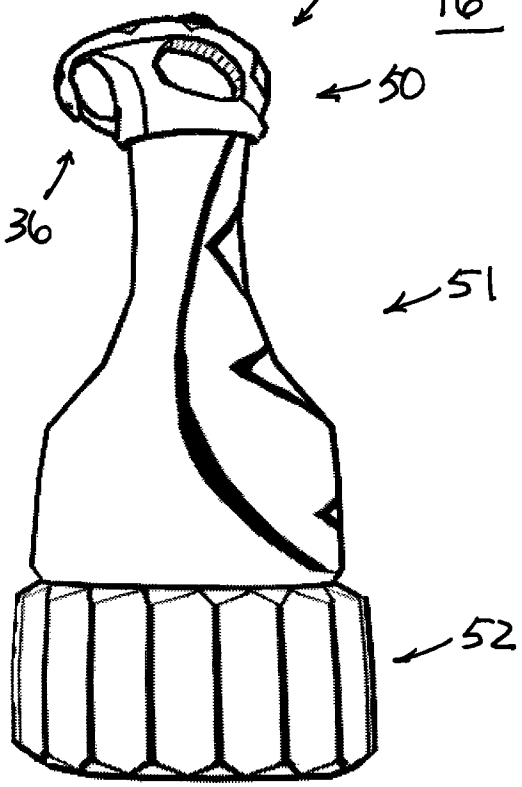
FIGS. 21A and 21B are side views of an embodiment of a "sword" drink bottle of the portable full-body workout system according to the present disclosure.
Figure 21A:
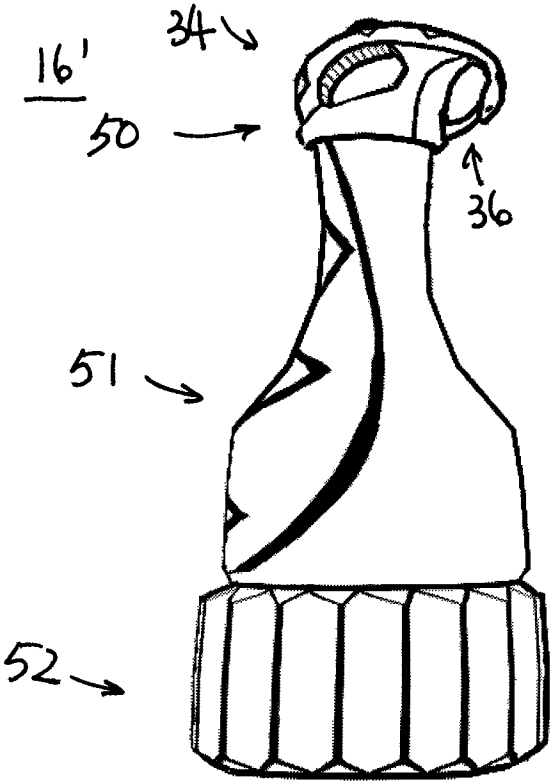
Figure 22A:
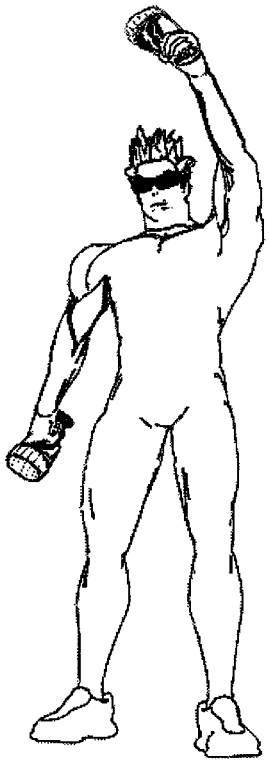
FIGS. 22A-22D are views of the various ways that a user may workout using the "sword" drink bottles according to the present disclosure.
Figure 22B:
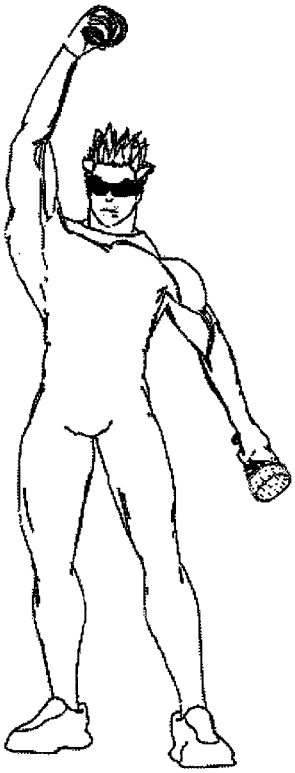
Figure 22C:
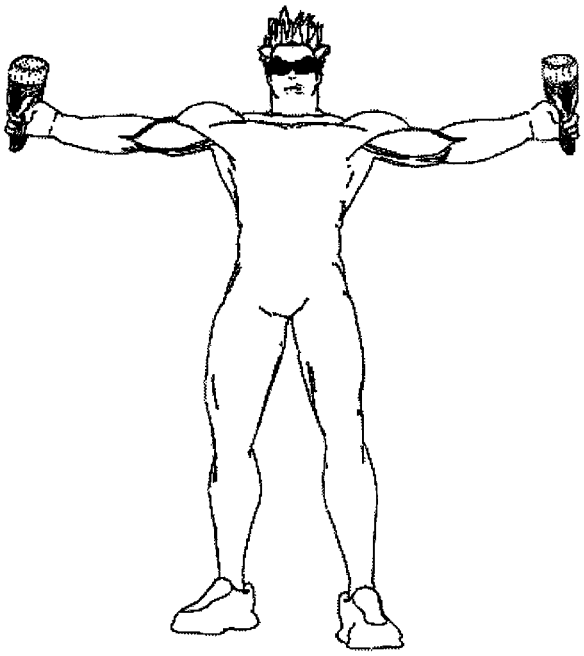
Figure 22D:
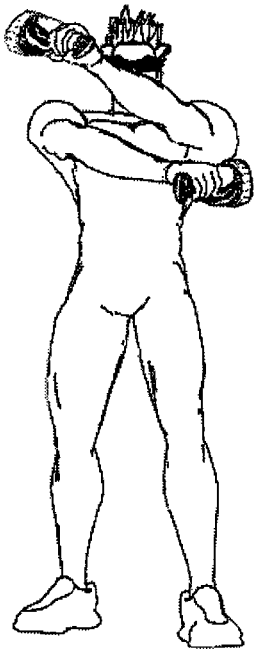
Figure 23A:
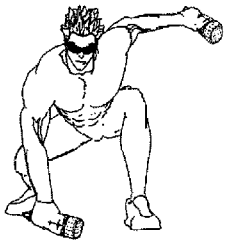
FIGS. 23A-23D are views of the various ways that a user may workout using the "sword" drink bottles according to the present disclosure.
Figure 23B:
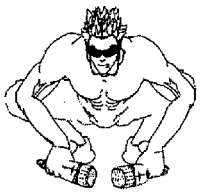
Figure 23C:
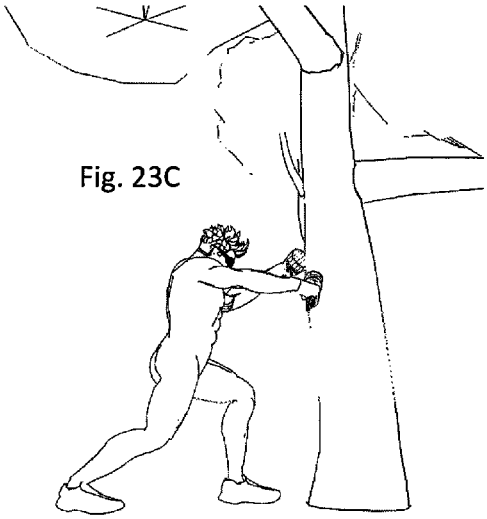
Figure 23D:
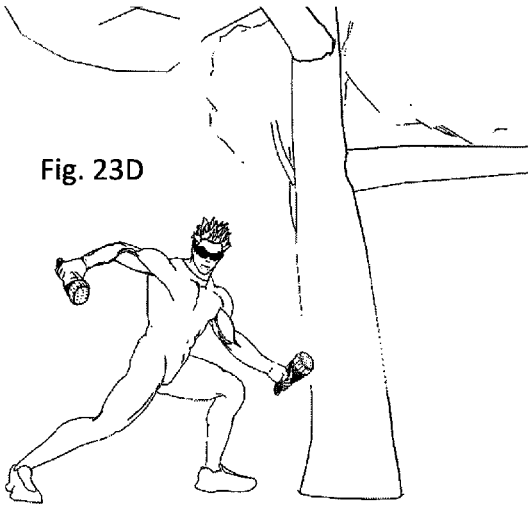

FIGS. 21A and 21B are side views of an embodiment of a "sword" drink bottle component 16' of the portable full-body workout system 10 according to the present disclosure. The "sword" drink bottle 16' comprises a lid or top 50 that includes the loop configuration 34 and a quick-release latch mechanism 36. The top 50 may be a hinged flip-top. The top 50 and the top edge of the body 51 may include matching threads that enable the top 50 to screw onto the drink bottle and form a water-tight seal. The body 51 of the drink bottle 16' preferably includes a stainless steel or plastic bottle that is thermally insulated to keep the beverage in the bottle temperature stable. The exterior of the body 51 may include a textured or rubberized surface to provide a cushioned and non-slip grip for the user. The "sword" drink bottle body 51 is characterized by a tapered profile, with a smaller diameter top end to be gripped by the user. The "sword" drink bottle 16' may be held by the user like a sword or hammer with moves that simulate sword fighting etc., such as shown in FIGS. 22A-22D. The swinging motion targets the shoulders, arms, as well as the legs and core. The added torque to the wrist in these types of moves further strengthens the forearm muscles. The bottom portion 52 of the drink bottle 16' may include a separate weight compartment to accommodate sand or sand bags that provides additional weight and cushioning for the drink bottle. The exterior of the bottom portion 52 includes a rubberized or textured non-slip surface. The weight compartment may be a zippered compartment that is accessible by the user to adjust the amount of sand or the number of sand bags. Of course, the weight of the drink bottles are also adjustable and dependent on the amount of water or beverage in the bottles.

FIGS. 22A-22D are views of the various ways that a user may workout using the "sword" drink bottles, and FIGS. 23A-23D are views of the various additional ways that a user may workout using the "sword" drink bottles with swinging motions. FIGS. 23A-23D show moves using the "sword" drink bottle by pushing against various stationary surfaces and objects for increased resistance training.

Figure 24B:
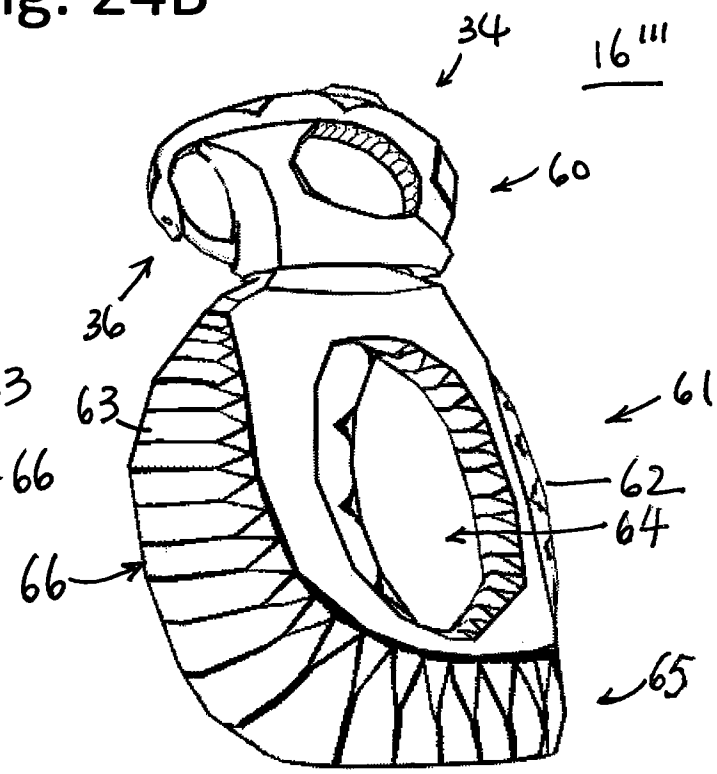
FIGS. 24A and 24B are side views of an embodiment of a "knuckle" drink bottle of the portable full-body workout system according to the present disclosure.
Figure 24A:
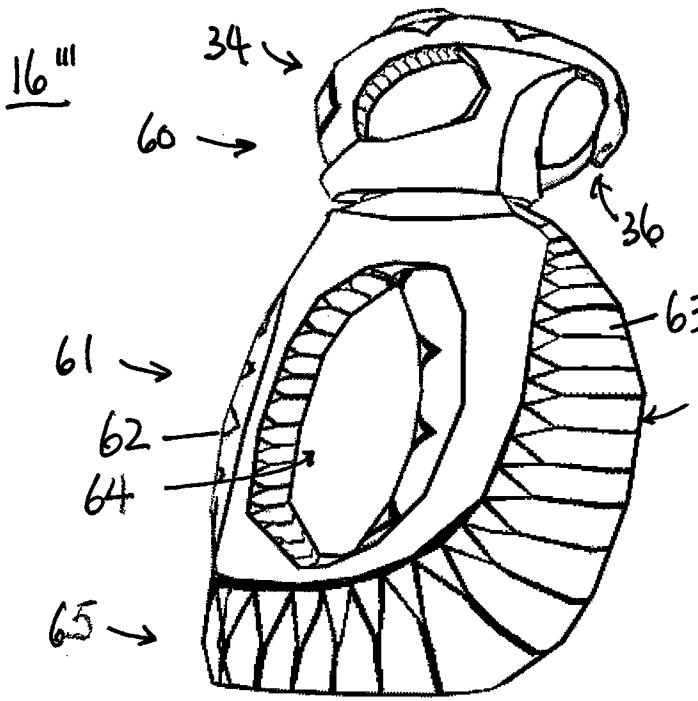
Figure 25A:
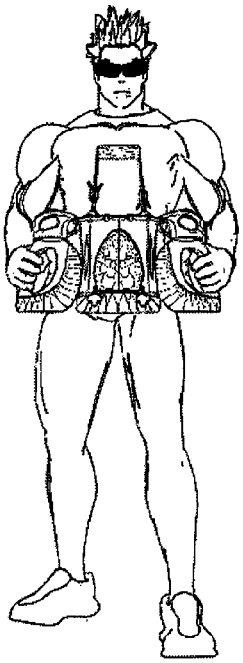
FIGS. 25A-25D are views of the various ways that a user may workout using the "knuckle" drink bottles according to the present disclosure.
Figure 25B:
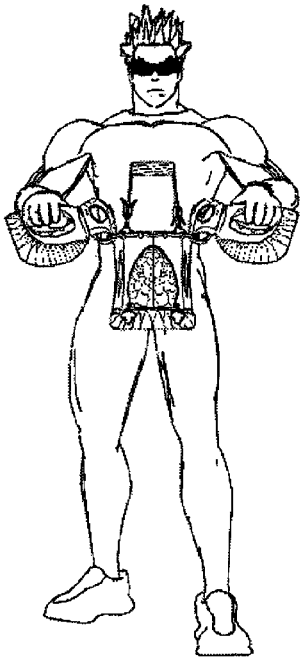
Figure 25C:
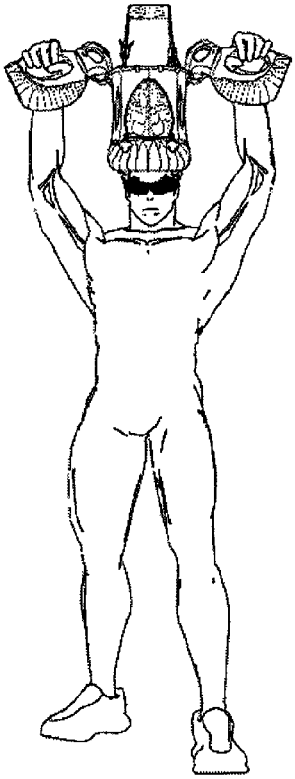
Figure 25D:
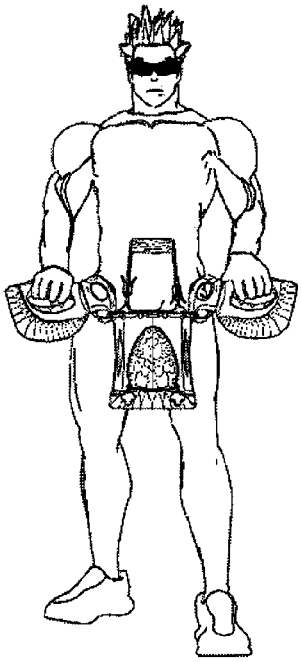
Figure 26A:
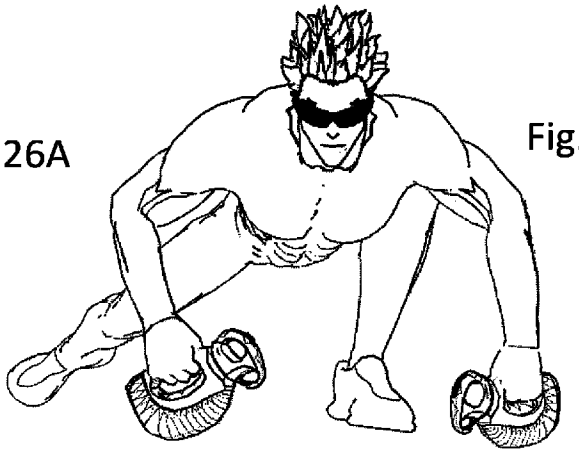
FIGS. 26A-26D are views of the various ways that a user may workout using the "knuckle" drink bottles according to the present disclosure.
Figure 26B:
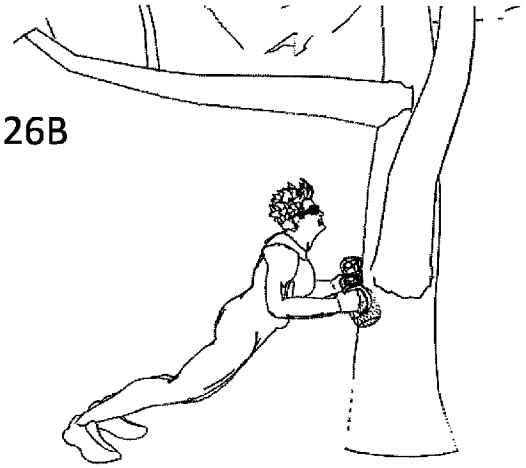
Figure 26C:
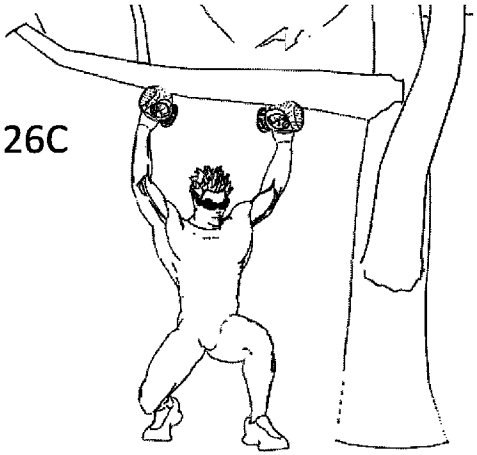
Figure 26D:
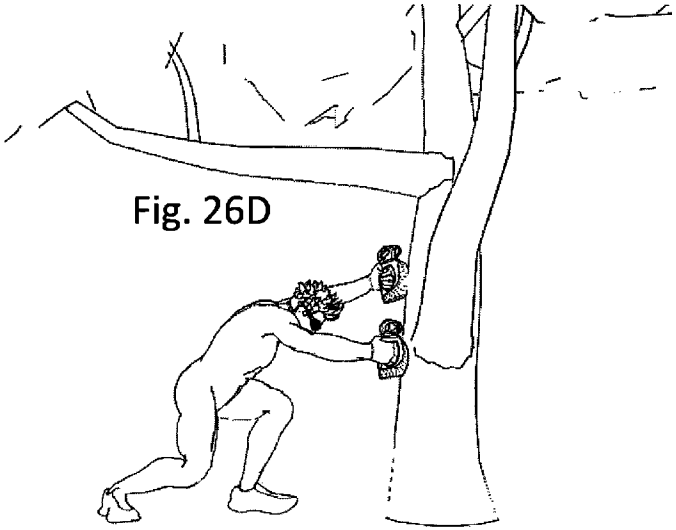

FIGS. 24A and 24B are side views of an embodiment of a "knuckle" drink bottle component 16' of the portable full-body workout system 10 according to the present disclosure. Like the "dumbbell" and "sword" drink bottles, the "sword" drink bottles 16' also comprise a lid or top 60 that includes the loop configuration 34 and quick-release latch mechanism 36. The top 60 may be a hinged flip-top. The top 60 and the top edge of the body 61 may include matching threads that enable the top 60 to screw onto the drink bottle and form a water-tight seal. The body 61 of the drink bottle 16''' may be thermally insulated to keep the drink contained inside the bottle temperature stable. The exterior of the body 61 may include a cushioned and textured non-slip surface to provide better and secure grip for the user. The "knuckle" drink bottle body 61 is characterized by a cushioned handle portion 62 meant to be gripped by the user and a knuckle portion 63. The handle and knuckle portions 62 and 63 further define a space 64 therebetween that accommodates the user's fingers and knuckles. The "knuckle" drink bottle 16''' further comprises a bottom portion 65 that includes a rubberized texture and is weighted to provided additional weight to the drink bottle. The textured surface of the bottom portion 65 extends up the knuckle side 66 of the bottle body 61. The "knuckle" drink bottle 16''' may be held by the user such as shown in FIGS. 25A-26D. The bottom portion 64 of the drink bottle 16''' may include a compartment to accommodate sand or sand bags that provide additional weight and cushioning for the drink bottle. A separate weight compartment that stores sand or sand bags may be formed in the bottom portion 65. The weight compartment may be a zippered compartment that is accessible by the user to adjust the amount of sand or the number of sand bags. Of course, the weight of the drink bottles are also dependent on the amount of water or drink in the bottles.

FIGS. 25A-25D are views of the various ways that a user may workout using the "knuckle" drink bottles and the portable full-body workout system according to the present disclosure. The user may hold the "knuckle" drink bottles attached to the cooler and use them like handles. These moves uses the combined weight of the cooler and the "knuckle" drink bottles for two-handed lifts.

FIGS. 26A-26D are additional views of the various ways that a user may workout using the "knuckle" drink bottles according to the present disclosure. The user may use a "knuckle" drink bottle in each hand and do knuckle push-ups against the ground and other immobile objects.

Figure 27A:
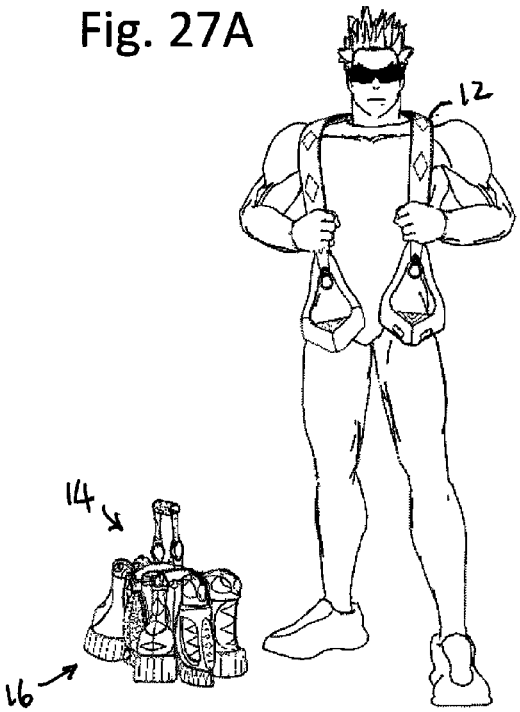
FIGS. 27A-27C are perspective views of an exemplary embodiment of a full-body workout strap carried in a number of ways according to the present disclosure.
Figure 27B:
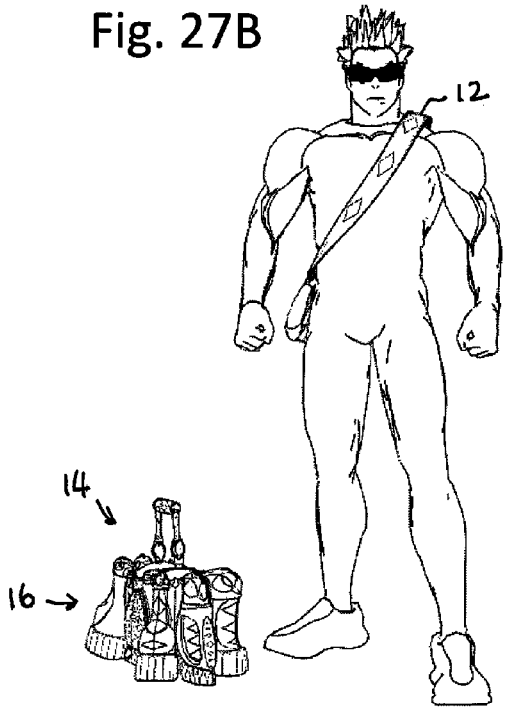
Figure 27C:
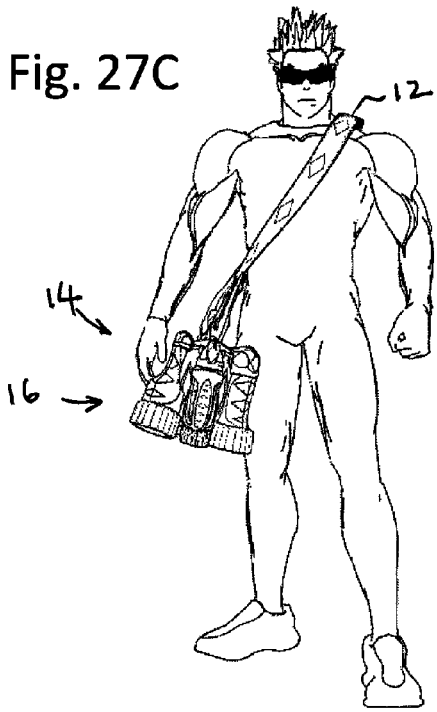

FIGS. 27A-27C are perspective views of an exemplary embodiment of a full-body workout strap 12 carried in a number of ways by a user according to the present disclosure. The full-body workout strap 12 may be slung around the user's shoulders, across the chest, or used to carry the cooler 14 and drink bottles 16.

Figures 28A, 28B, 28C:
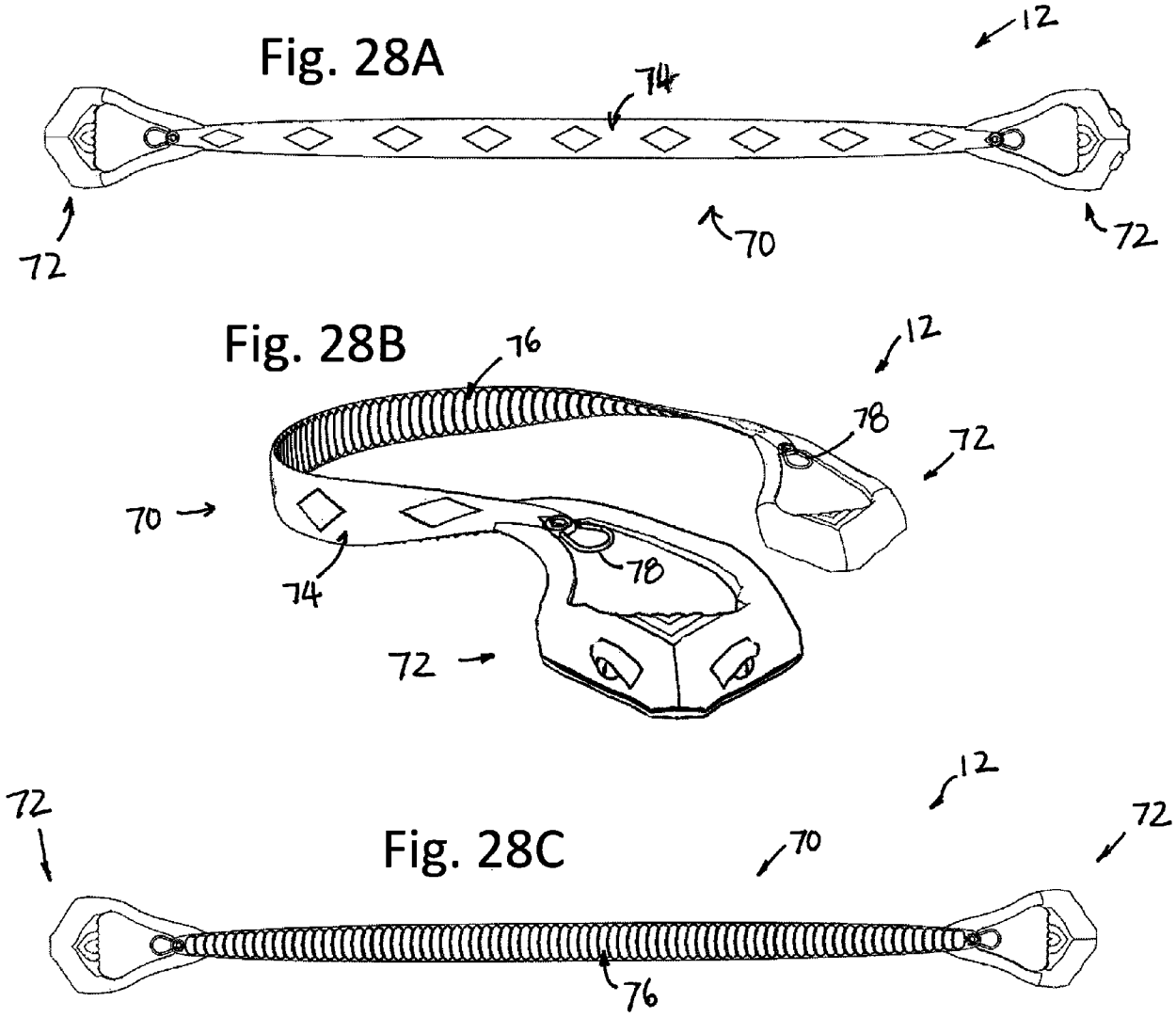
FIGS. 28A-28C are various views of an exemplary embodiment of a full-body workout strap according to the present disclosure.

FIGS. 28A-28C are various views of an exemplary embodiment of a full-body workout strap 12 according to the present disclosure. The full-body workout strap 12 includes a strap body 70 with a hand grip 72 at each end. The strap body 70 is preferably constructed of a durable material that can generally maintain its shape and yet sufficiently flexible to allow the strap to be folded over upon itself. Suitable materials for fabricating the strap body 70 may include nylon webbing, plastic, leather, etc. A top surface 74 of the strap body 70 may incorporate a soft and flexible material with a snake skin design, and a bottom surface 76 of the strap body 70 may have a durable non-slip rubberized texture with a snake belly design. The hand grips 72 at the ends of the strap 12 are generally constructed of a metal or rigid plastic material, preferably with added layers of durable padding to provide a comfortable grip and to protect the user from inadvertent bruising on contact with a swinging strap. The hand grips 72 preferably incorporate a snake head design. Incorporated in the hand grips 72 are latching mechanisms 78 at each end that may be spring-loaded clips that enable the full-body strap 12 to be easily attached and detached from the cooler 14. The latching mechanism 78 also enable the two ends of the strap 12 to be fastened to one another.

Figure 29A:
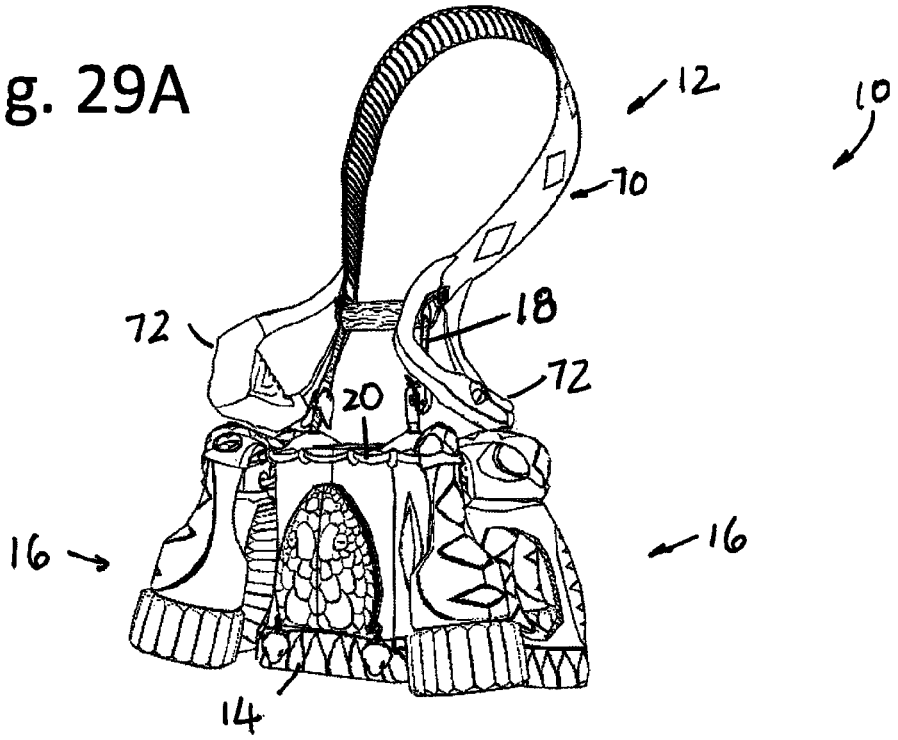
FIGS. 29A and 29B are perspective and partial views of an exemplary embodiment of a portable full-body workout system with the full-body workout strap attached to the cooler according to the present disclosure.
Figure 29B:
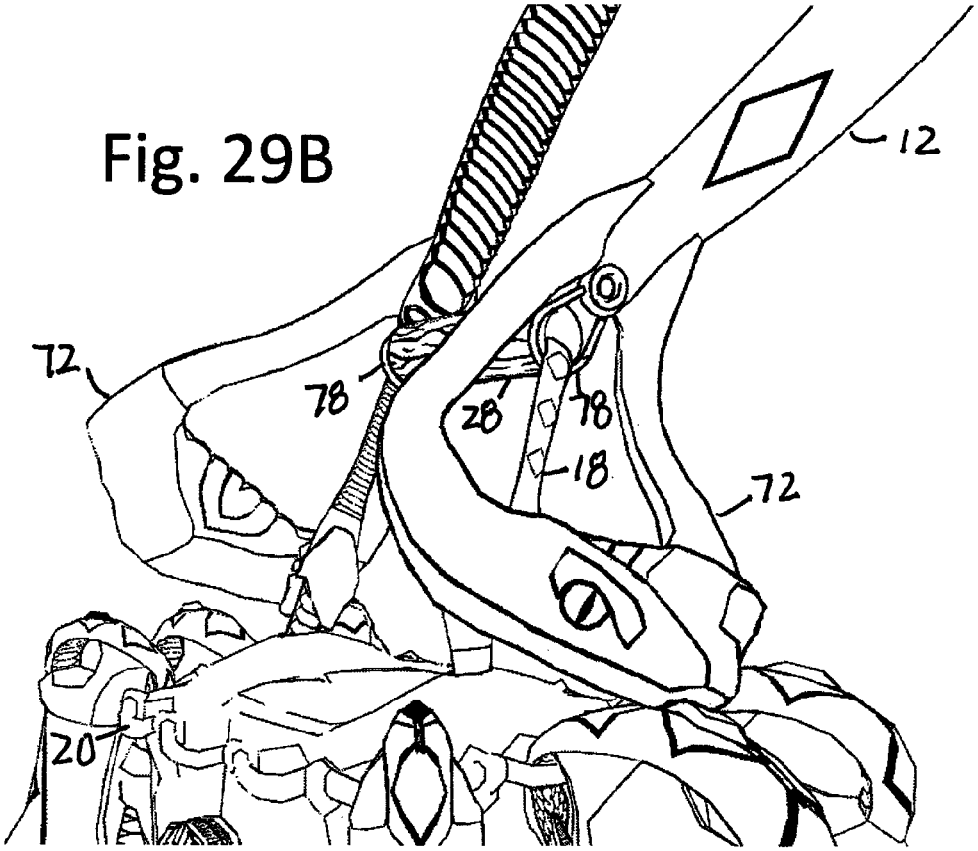

FIGS. 29A and 29B are perspective and partial views of an exemplary embodiment of a portable full-body workout system 10 with the full-body workout strap 12 attached to the cooler 14 (with drink bottles 16 attached) according to the present disclosure. It may be seen that the clips 78 at the ends of the strap 12 may be used to fasten to the cooler handle 18. Alternatively, the clips 78 may fasten to other parts of the cooler, such as the sturdy ring 20 on which the drink bottles are also fastened.

Figure 30A:
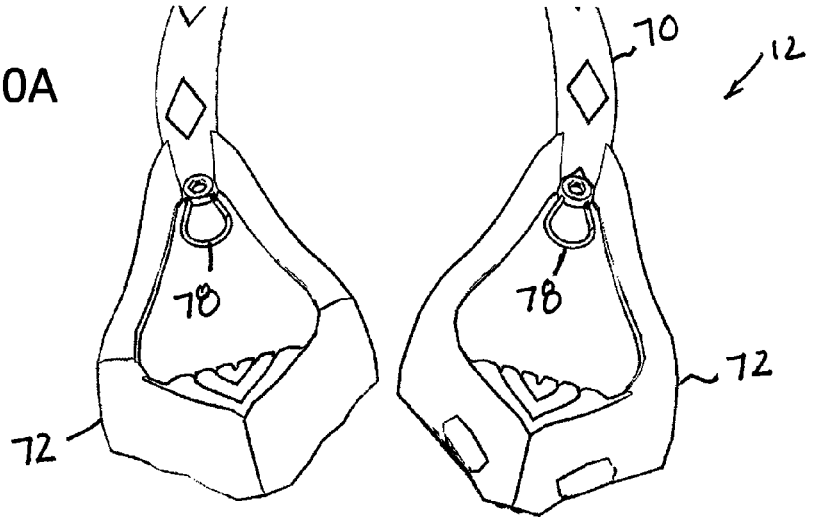
FIGS. 30A-30C are detailed partial views of an exemplary embodiment of a full-body workout strap hand grip and latching mechanism according to the present disclosure.
Figure 30B:
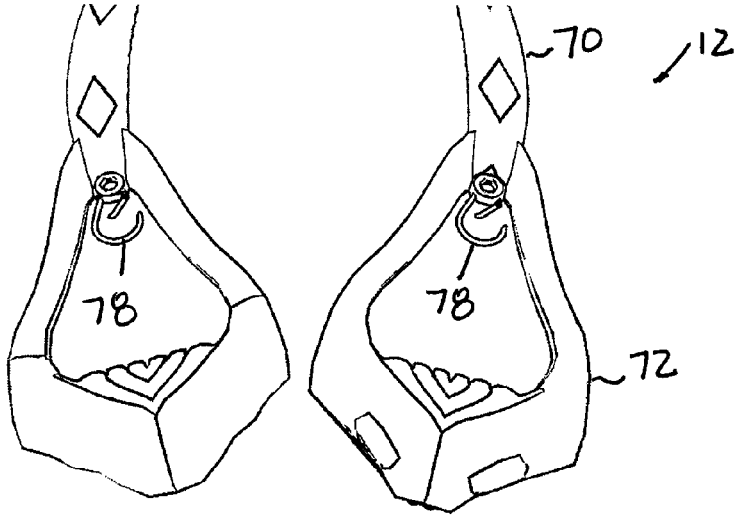
Figure 30C:
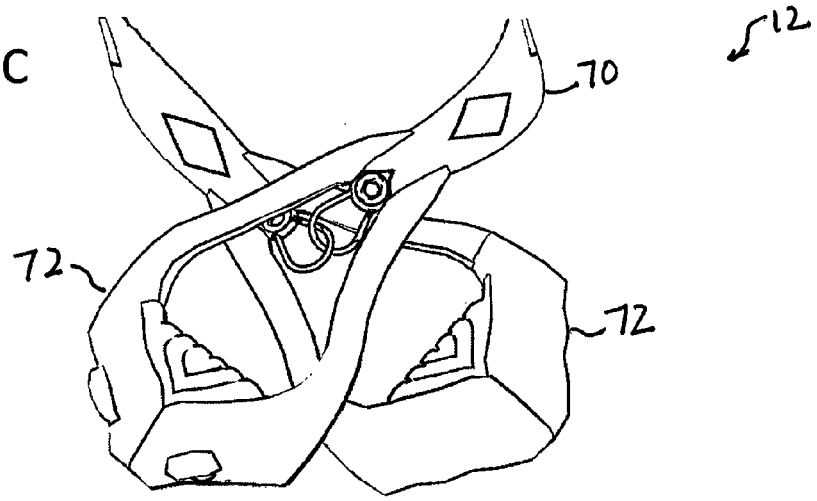

FIGS. 30A-30C are detailed partial views of an exemplary embodiment of a full-body workout strap 12 hand grip 72 and latching mechanism 78 according to the present disclosure. The full-body workout strap 12 includes a strap body 70, and a hand grip 72 and a latching mechanism 78 at each end. The latching mechanism 78 may include spring-loaded clips that can be easily fastened together and taken apart.

Figures 31A, 31B, 31C:
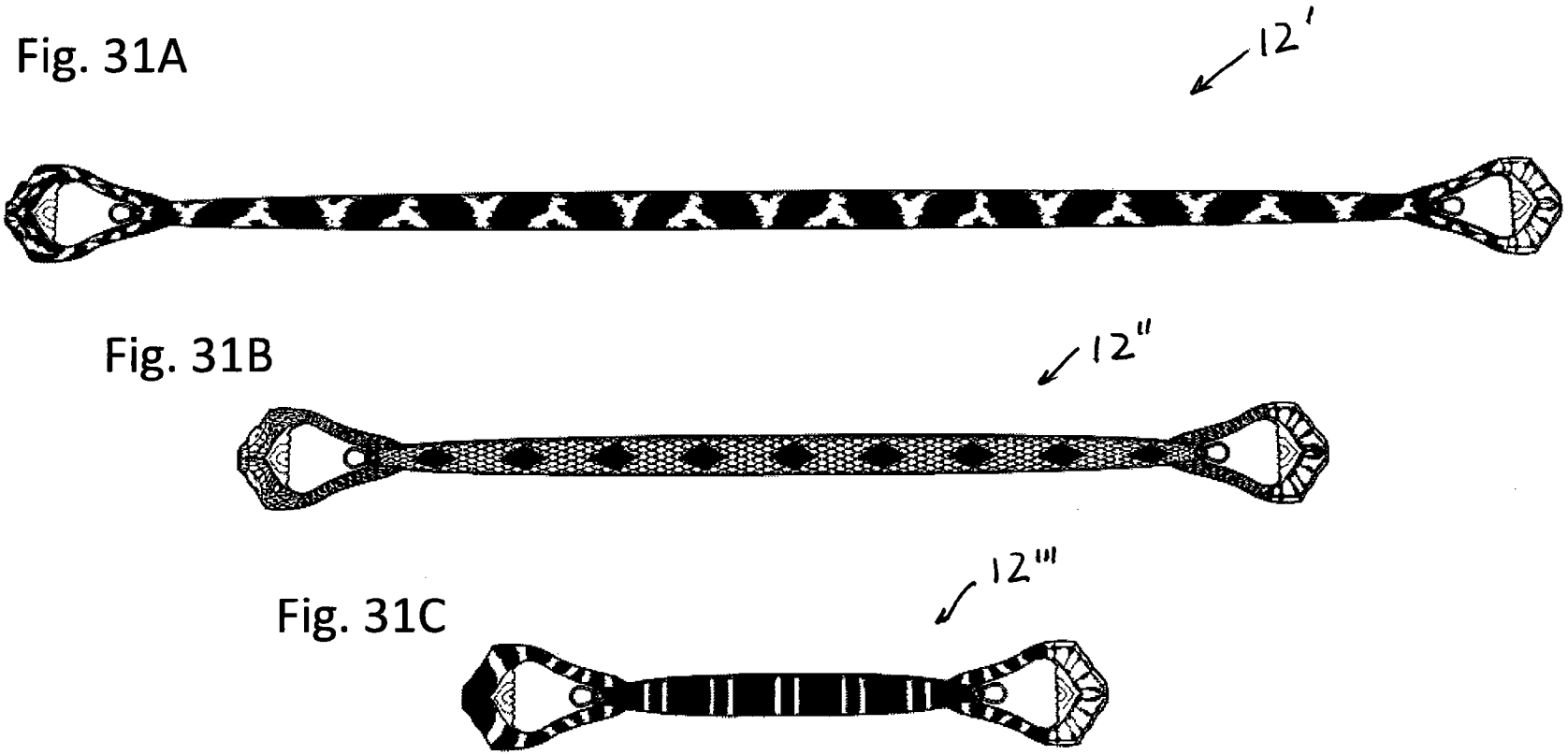
FIGS. 31A-31C are various views of exemplary embodiments of a full-body workout strap according to the present disclosure.
Figure 32A:
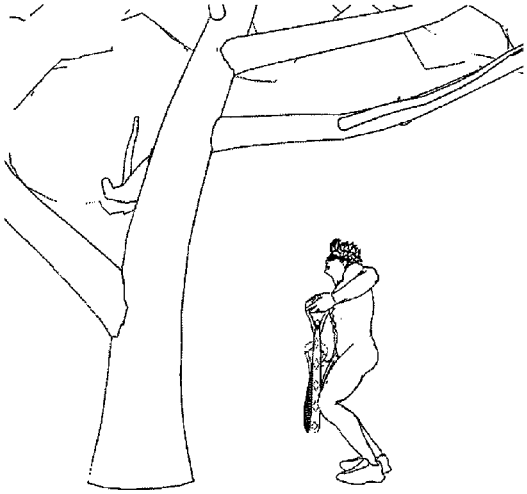
FIGS. 32A-32D are views of the various ways that a user may workout using the full-body workout strap with a horizontal structure according to the present disclosure.
Figure 32B:
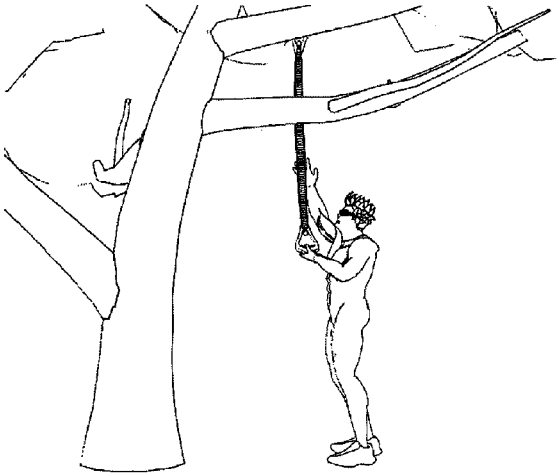
Figure 32C:
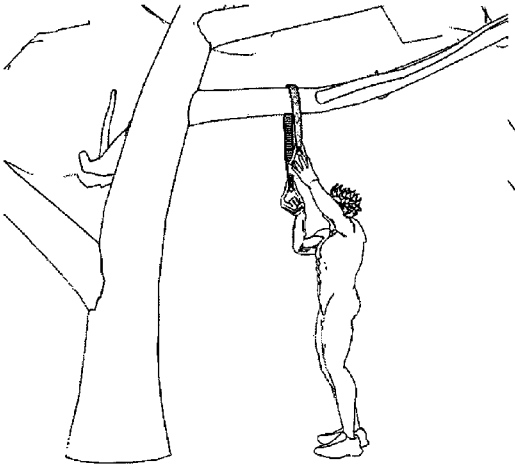
Figure 32D:
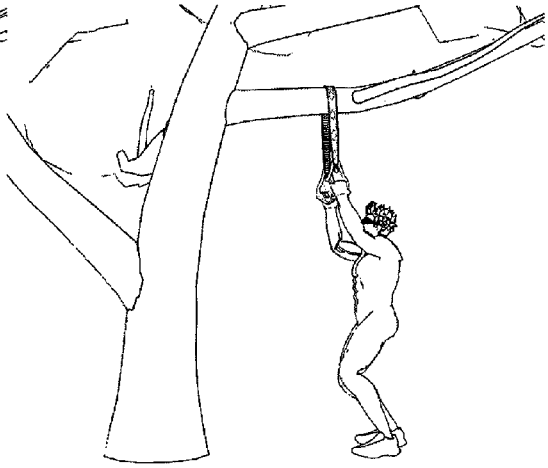
Figure 33A:
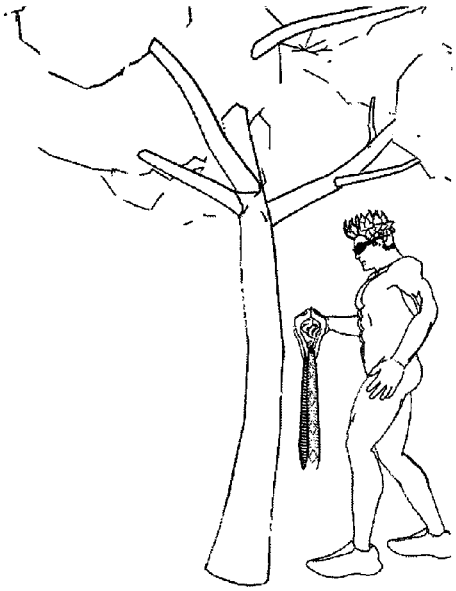
FIGS. 33A-33D are views of the various ways that a user may workout using the full-body workout strap with a vertical structure according to the present disclosure.
Figure 33B:
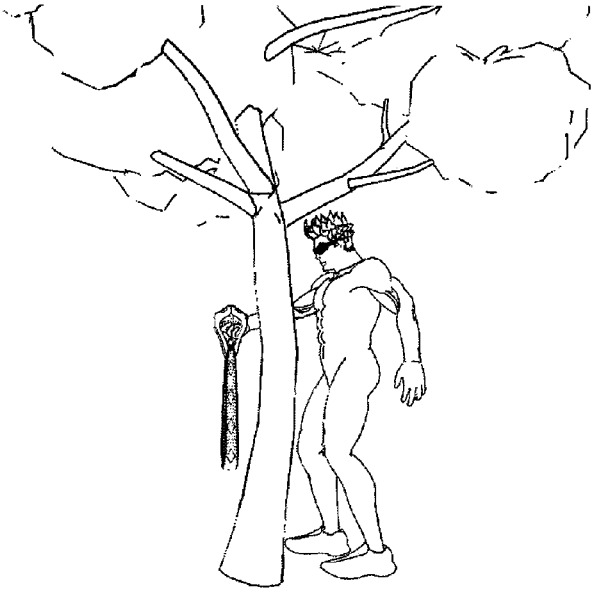
Figure 33C:
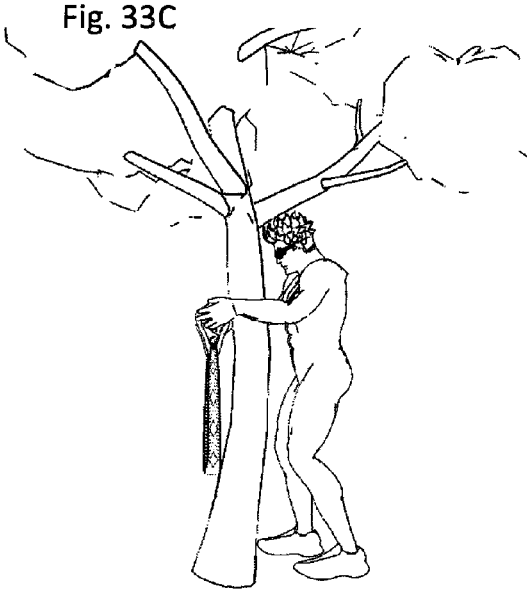
Figure 33D:
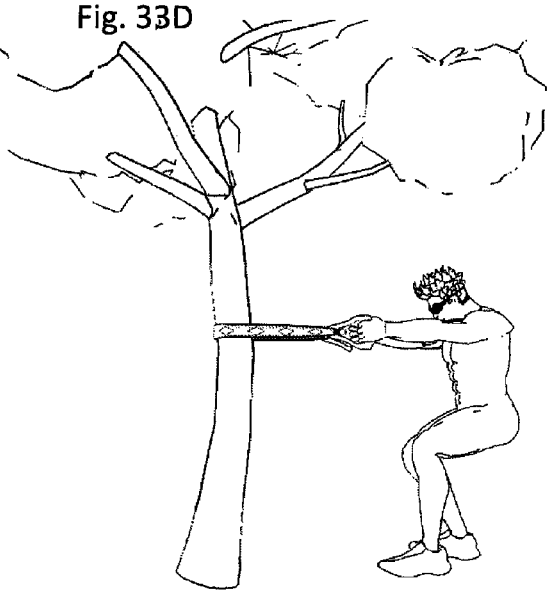
Figure 34A:
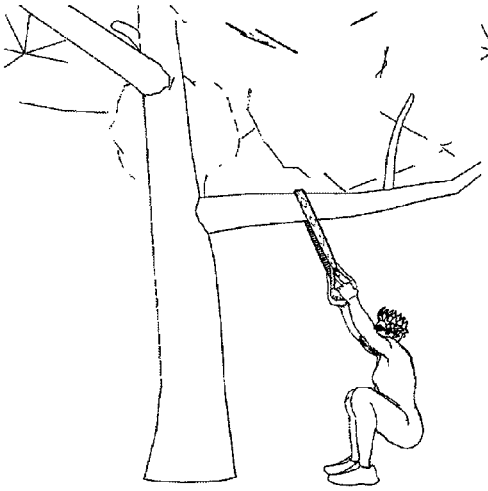
FIGS. 34A-34F are views of the various ways that a user may workout using the full-body workout strap according to the present disclosure.
Figure 34B:
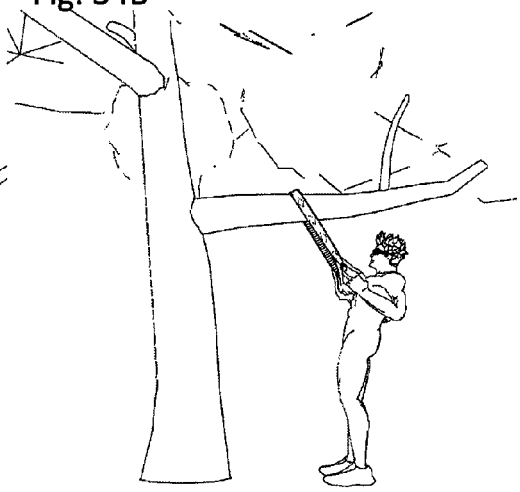
Figure 34C:
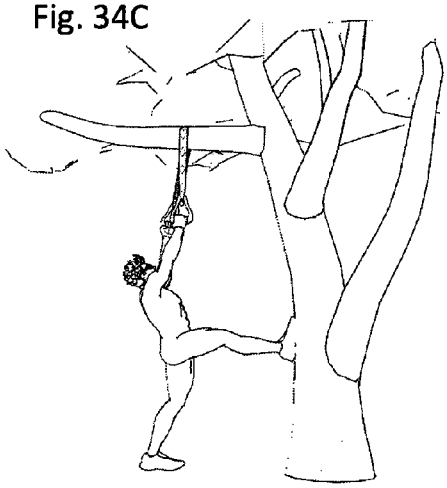
Figure 34D:
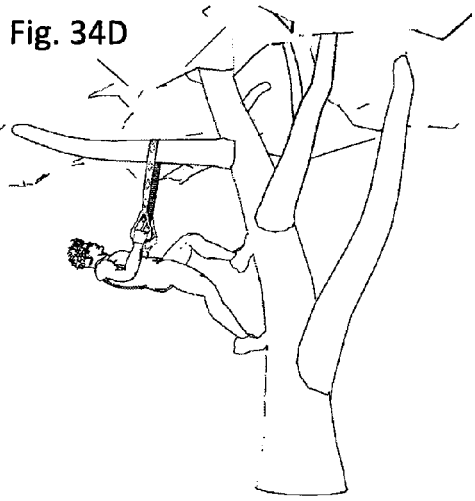
Figure 34E:
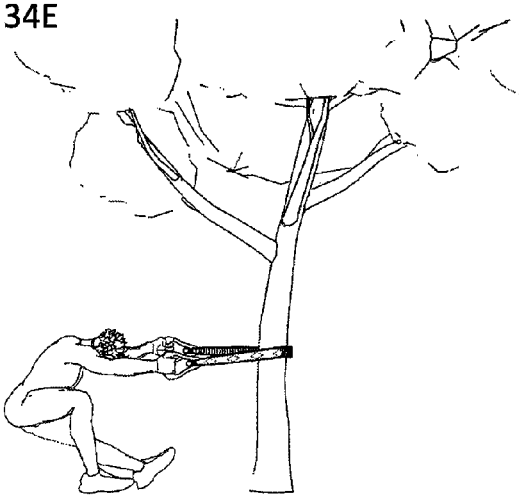
Figure 34F:
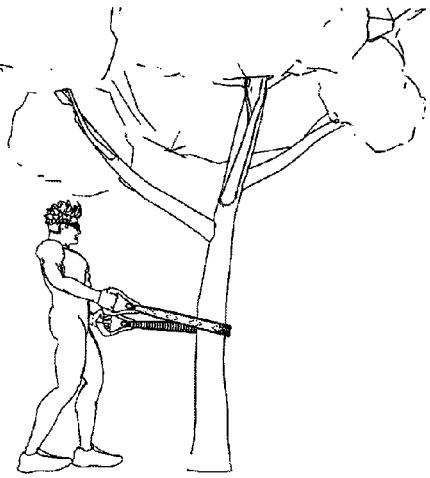
Figure 35A:
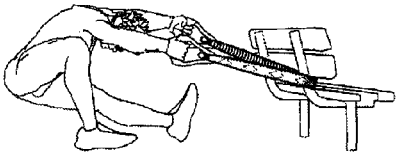
FIGS. 35A-35G are views of the various ways that a user may workout using the full-body workout strap according to the present disclosure.
Figure 35B:
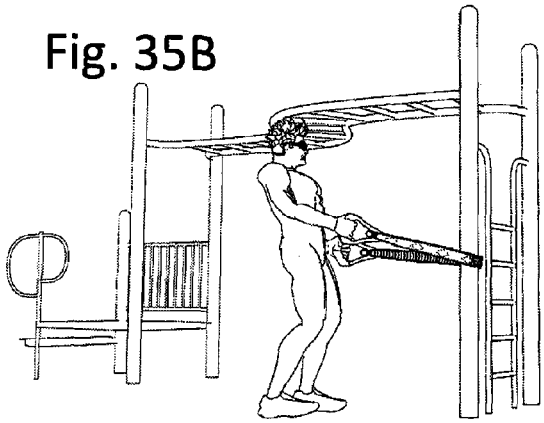
Figure 35C:
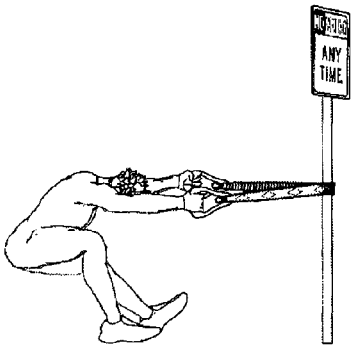
Figure 35D:
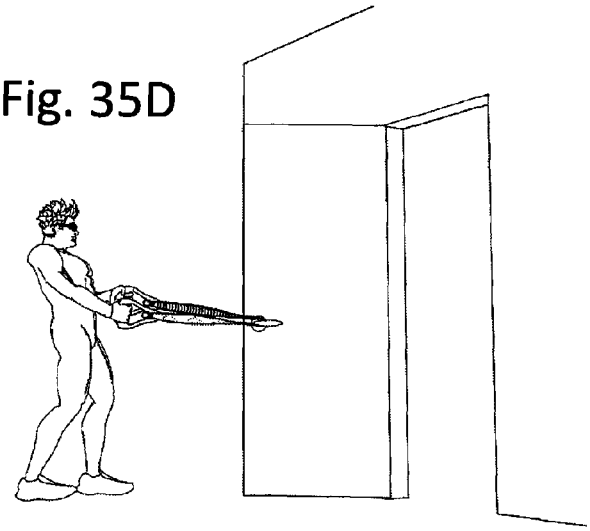
Figure 35E:
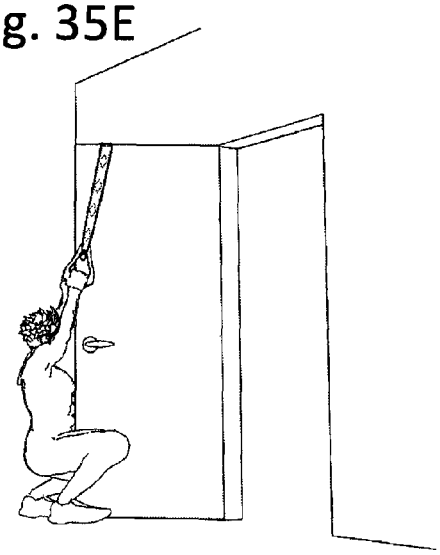
Figure 35F:
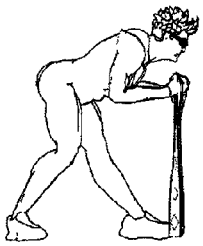
Figure 35G:
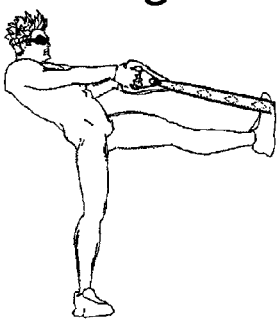

FIGS. 31A-31C are various views of exemplary embodiments of a full-body workout strap 12 according to the present disclosure. As shown, the full-body workout strap 12 (12'-12''') may be fabricated to have varying lengths that can be selected to best suit a user's body size and his/her workout routine. The strap 12 can also incorporate various designs and textures to enhance the aesthetics of the strap.

FIGS. 32A-32D are views of the various ways that a user may work out using the full-body workout strap described above with a generally horizontal immobile structure according to the present disclosure. The semi-rigid but flexible construction of the workout strap enables a user to easily extend and loop it over the overhead horizontal structure such as a tree branch, exercise bar, or rafters. The padded hand grips help to protect against accidental injury or bruises from inadvertent impact while it is being swung over the tree branch.

FIGS. 33A-33D are views of the various ways that a user may workout using the full-body workout strap described above with a generally vertical structure according to the present disclosure. The flexible construction of the workout strap enables the user to easily loop it over the vertical immobile structure such as a tree, post, or street sign. The textured and rubberized bottom surface of the strap enables a firm and secure grip on the structure.

FIGS. 34A-34F are views of the various ways that a user may workout using the full-body workout strap described above according to the present disclosure. The full-body workout strap is looped around a horizontal or vertical immobile structure that provides resistance. The user may use his/her own weight in addition to pulling against the immobile structure that work the back, arm, and leg muscles, and strengthen the core.

FIGS. 35A-35G are additional views of the various ways that a user may work out using the full-body workout strap described above according to the present disclosure. The full-body workout strap is looped around an immobile structure or object commonly found in a park, playground, sidewalk, or home that provides resistance. The user may even loop the strap around his own foot or feet to use his own weight to provide resistance. Using the strap, the user may perform pulling or rowing motions that work the back, arm, and leg muscles, and strengthen the core.

Figure 36A:
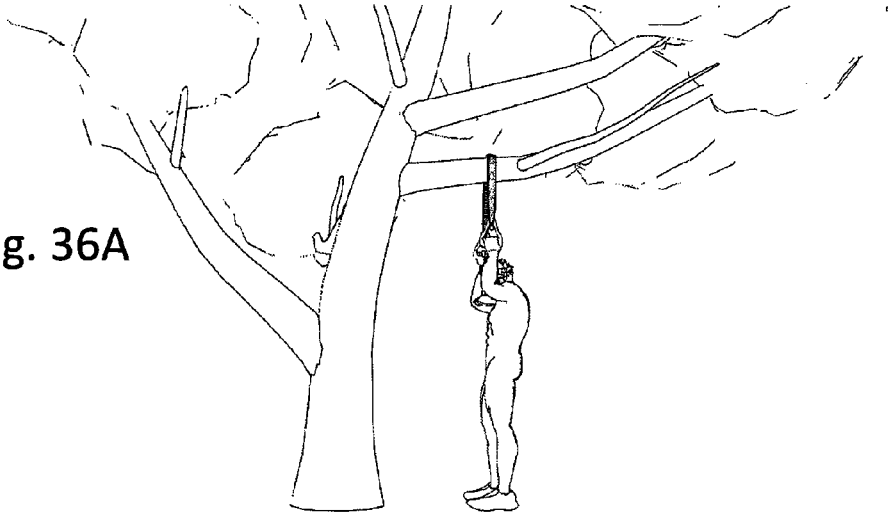
FIGS. 36A-36C are views of a user adjusting the position of the full-body workout strap around a horizontal structure according to the present disclosure.
Figure 36B:
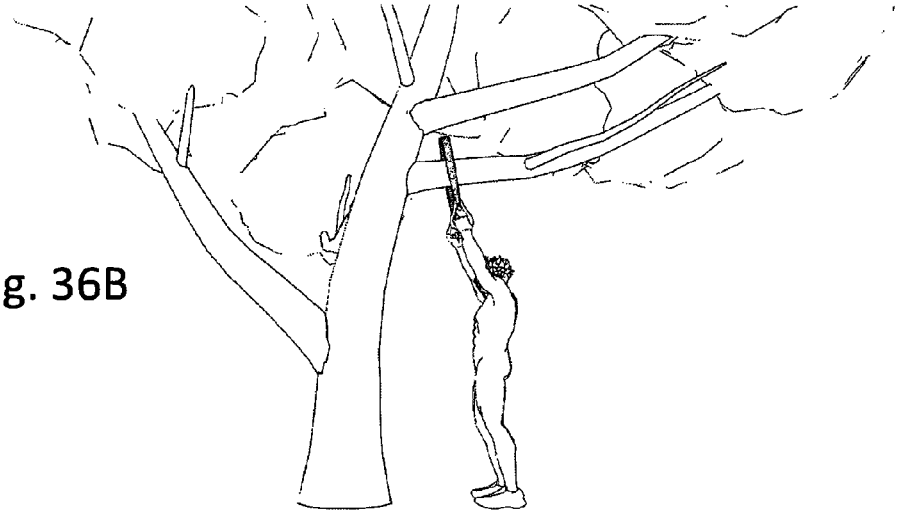
Figure 36C:
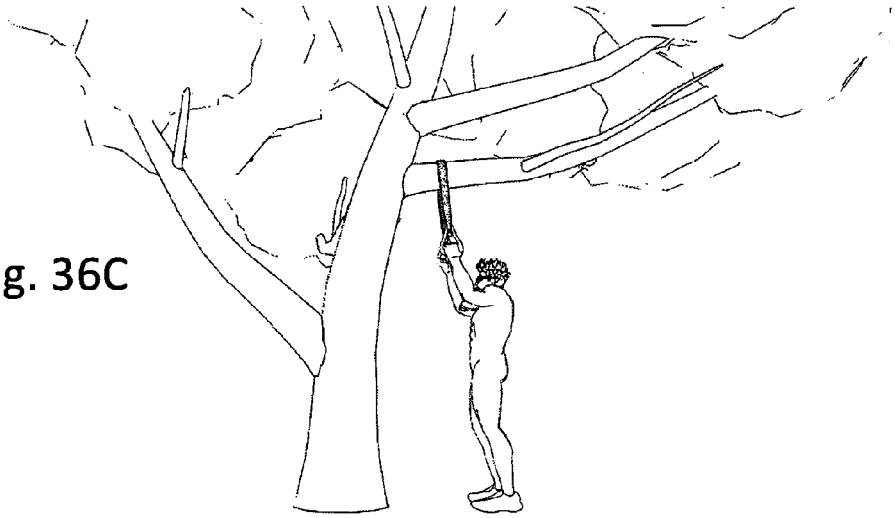

FIGS. 36A-36C are views of a user adjusting the position of the full-body workout strap described above around a horizontal structure according to the present disclosure. It may be seen that because of its semi-rigid structure, the position of the strap may be easily shifted or moved along the horizontal structure. In this manner, the user may perform moves using, for example, the horizontal tree branch as well as the vertical trunk of the tree, where some moves may require a closer distance between the strap and the tree trunk.

This endless degree of adjustability of the strap's position is not possible in conventional fixed point suspension training devices.

Figure 37A:
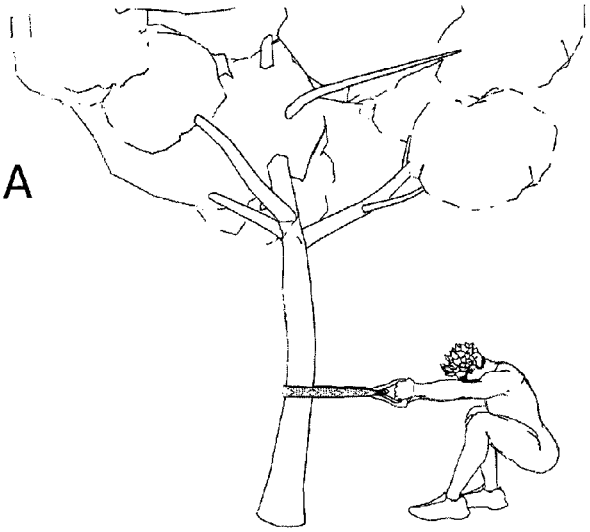
FIGS. 37A-37C are views of a user adjusting the position of the full-body workout strap around a vertical structure according to the present disclosure.
Figure 37B:
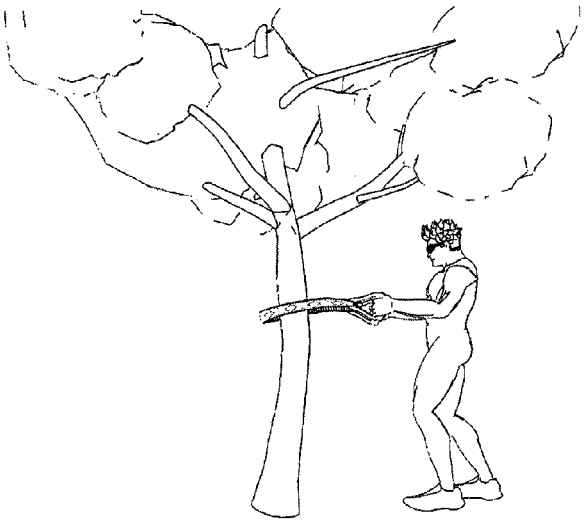
Figure 37C:
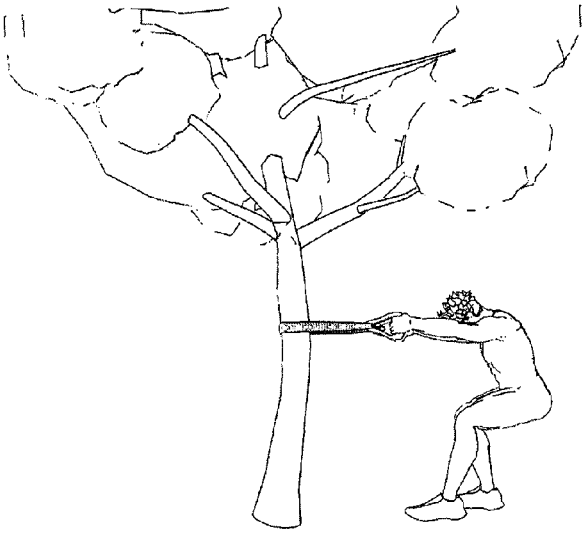

FIGS. 37A-37C are views of a user adjusting the position of the full-body workout strap described above around a vertical structure according to the present disclosure. Again, due to the semi-rigidity of the strap, the point at which the strap is anchored around the vertical structure may be easily adjusted so that the user can perform moves that provide nuanced variations in strengthening the various muscles in the arms, shoulders, legs, and the core.

Figure 38A:
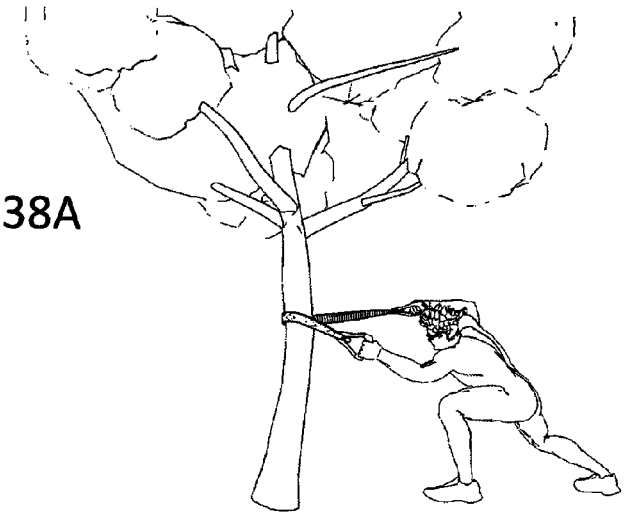
FIGS. 38A-38C are views of a user adjusting an asymmetrical position of the full-body workout strap according to the present disclosure.
Figure 38B:
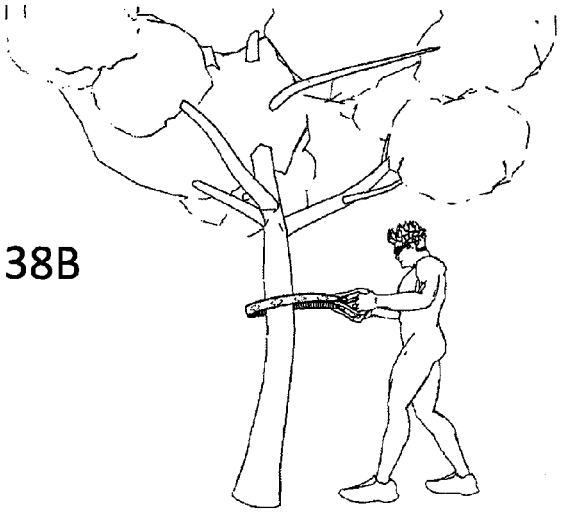
Figure 38C:
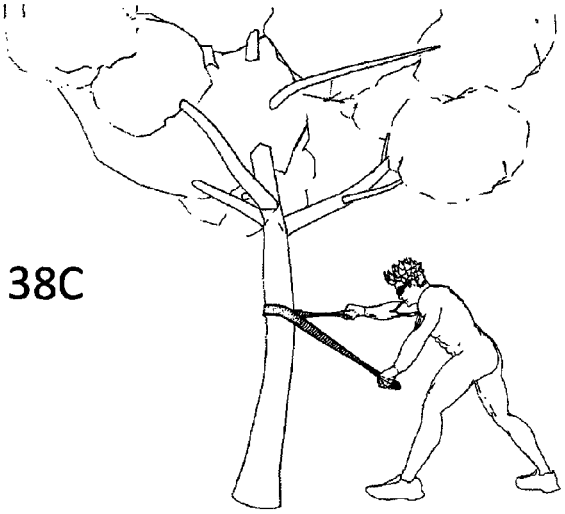

FIGS. 38A-38C are views of a user adjusting an asymmetrical position of the full-body workout strap described above according to the present disclosure. The user may adjust the full-body workout strap to be anchored not at a mid-point to the immobile structure at so that uneven lengths of the strap are extended from the structure. This method provides the user an even wider range of motion and workout options.

Figure 39A:
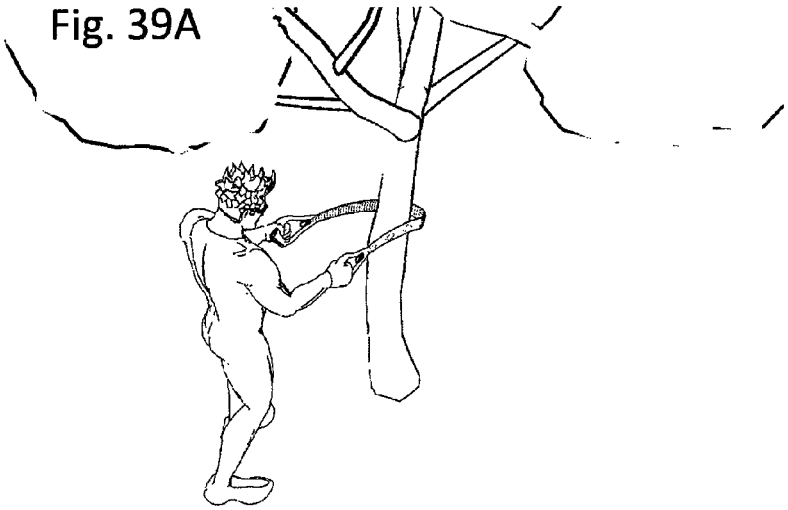
FIGS. 39A-39C are views of a user using a cross-over position of the full-body workout strap according to the present disclosure.
Figure 39B:
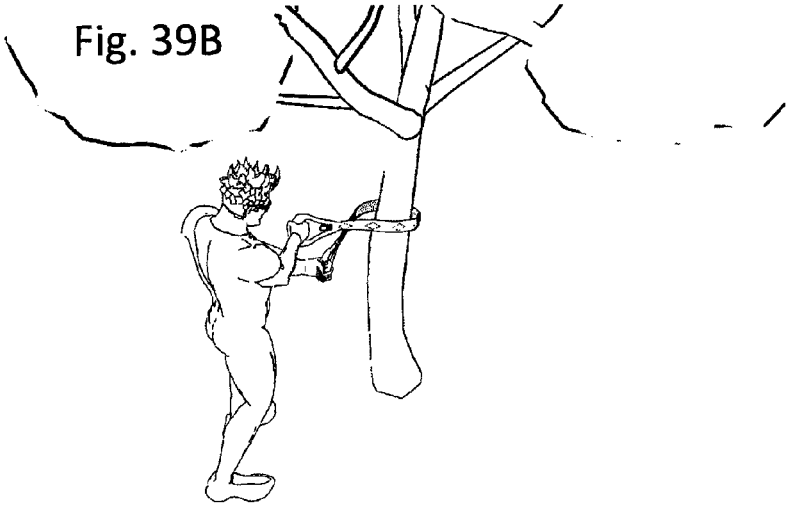
Figure 39C:
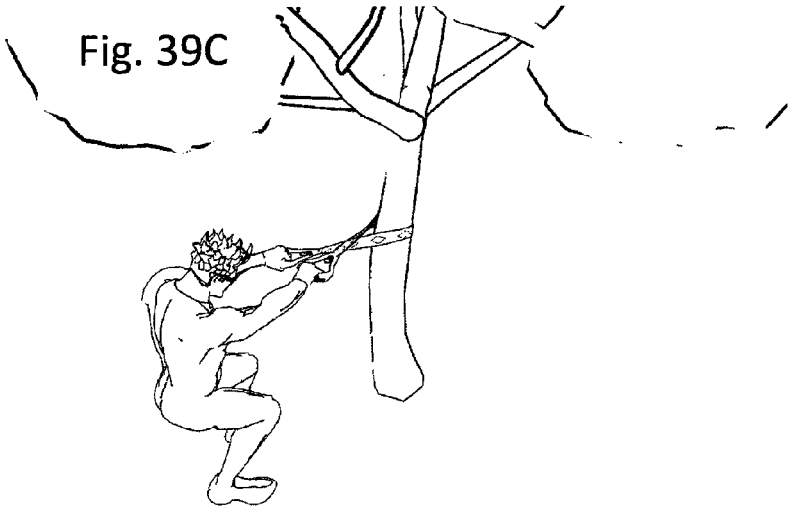
Figure 40A:
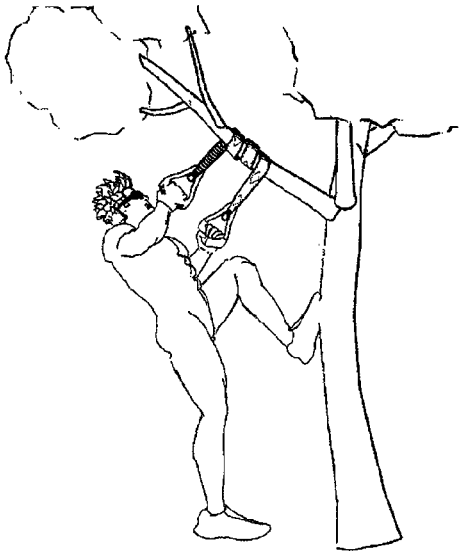
FIGS. 40A-40D are views of the various ways that a user may workout using the full-body workout strap according to the present disclosure.
Figure 40B:
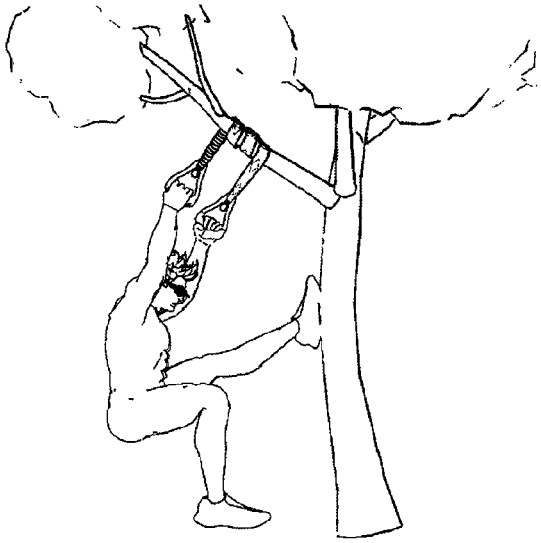
Figure 40C:
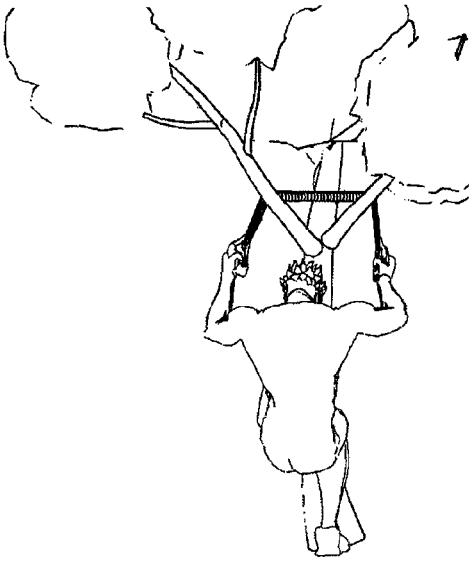
Figure 40D:
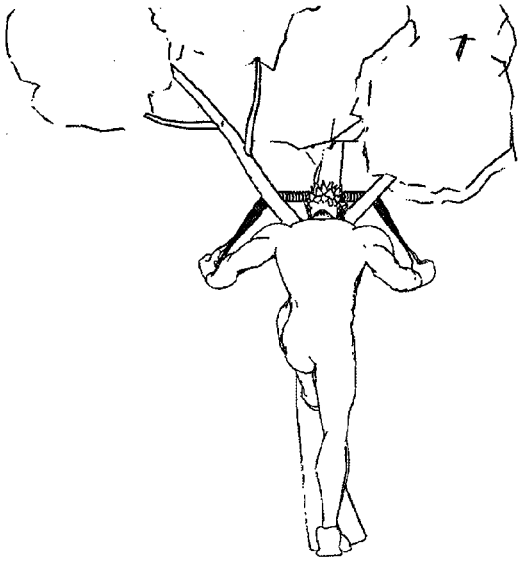
Figure 41A:
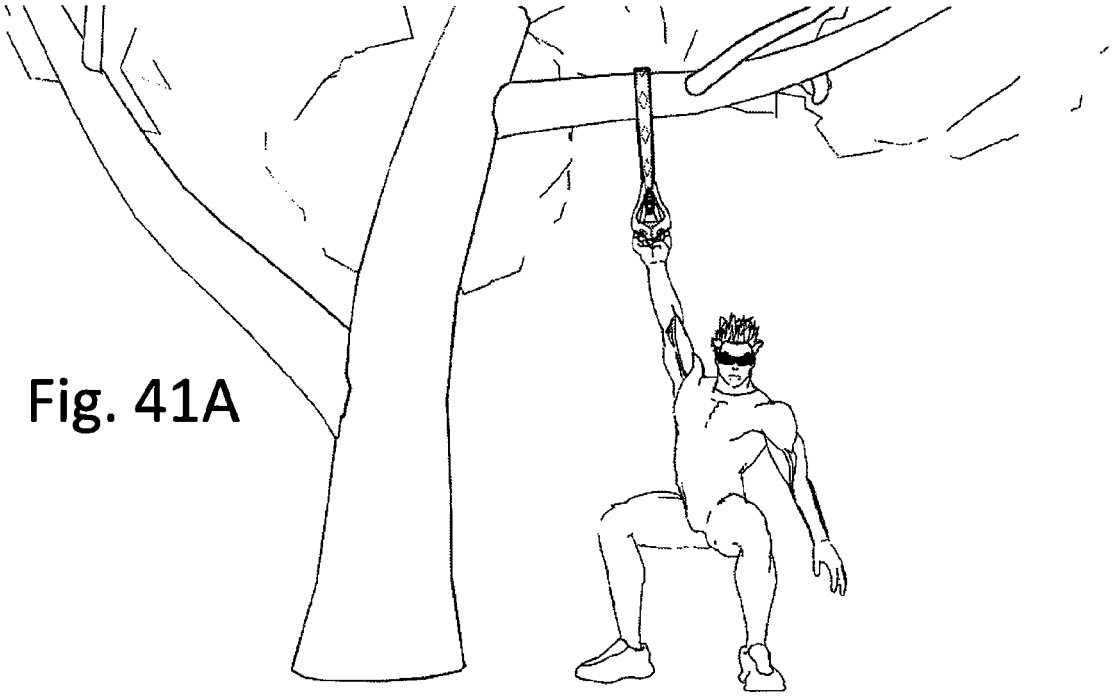
FIGS. 41A and 41B are views of a user using a one-handed position of the full-body workout strap according to the present disclosure.
Figure 41B:
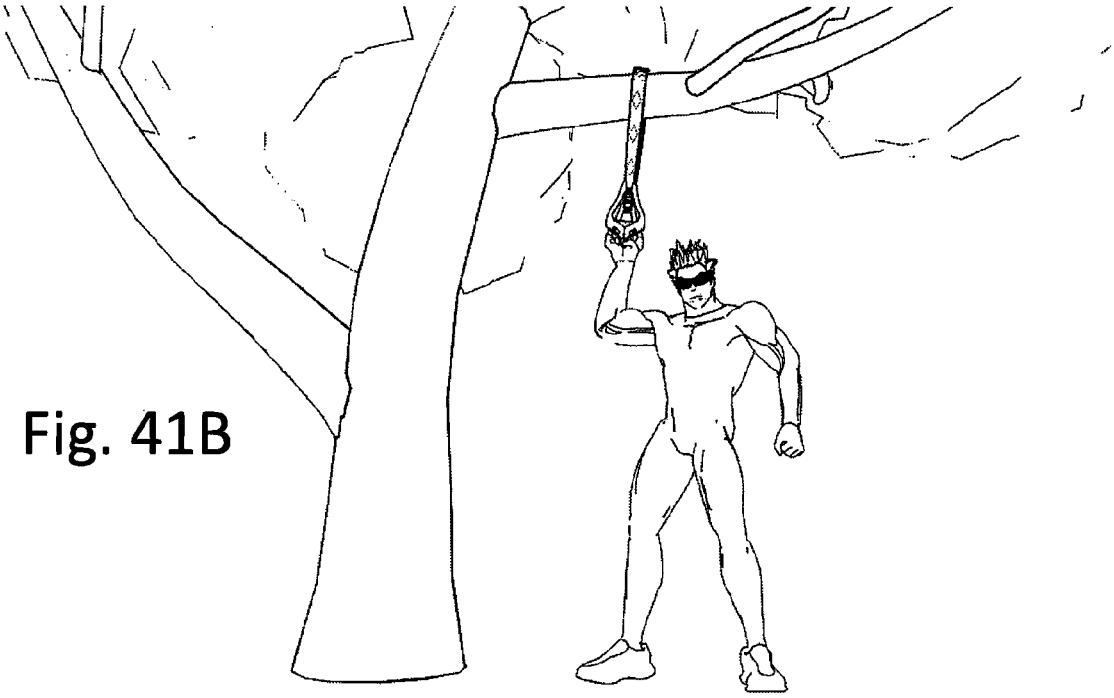

FIGS. 39A-39C are views of a user using a cross-over configuration of the full-body workout strap described above according to the present disclosure. The strap may be used in a cross-over configuration for added grip against the immobile structure for more extreme moves and motions.

FIGS. 40A-40D are views of the various ways that a user may work out using the full-body workout strap described above according to the present disclosure. Using a longer length strap, the user may wrap the strap around the immobile structure for non-slip action. The strap can also be looped around objects that have a wider span (e.g., around two tree branches) to vary the angle of arm and shoulder motion so that different muscles can be worked.

FIGS. 41A-41D are views of a user using a one-handed position of the full-body workout strap described above according to the present disclosure. As shown, the latching mechanism of the strap may be used to secure the two ends of the strap together for one-handed moves.

Figures 42A, 42B, 42C:
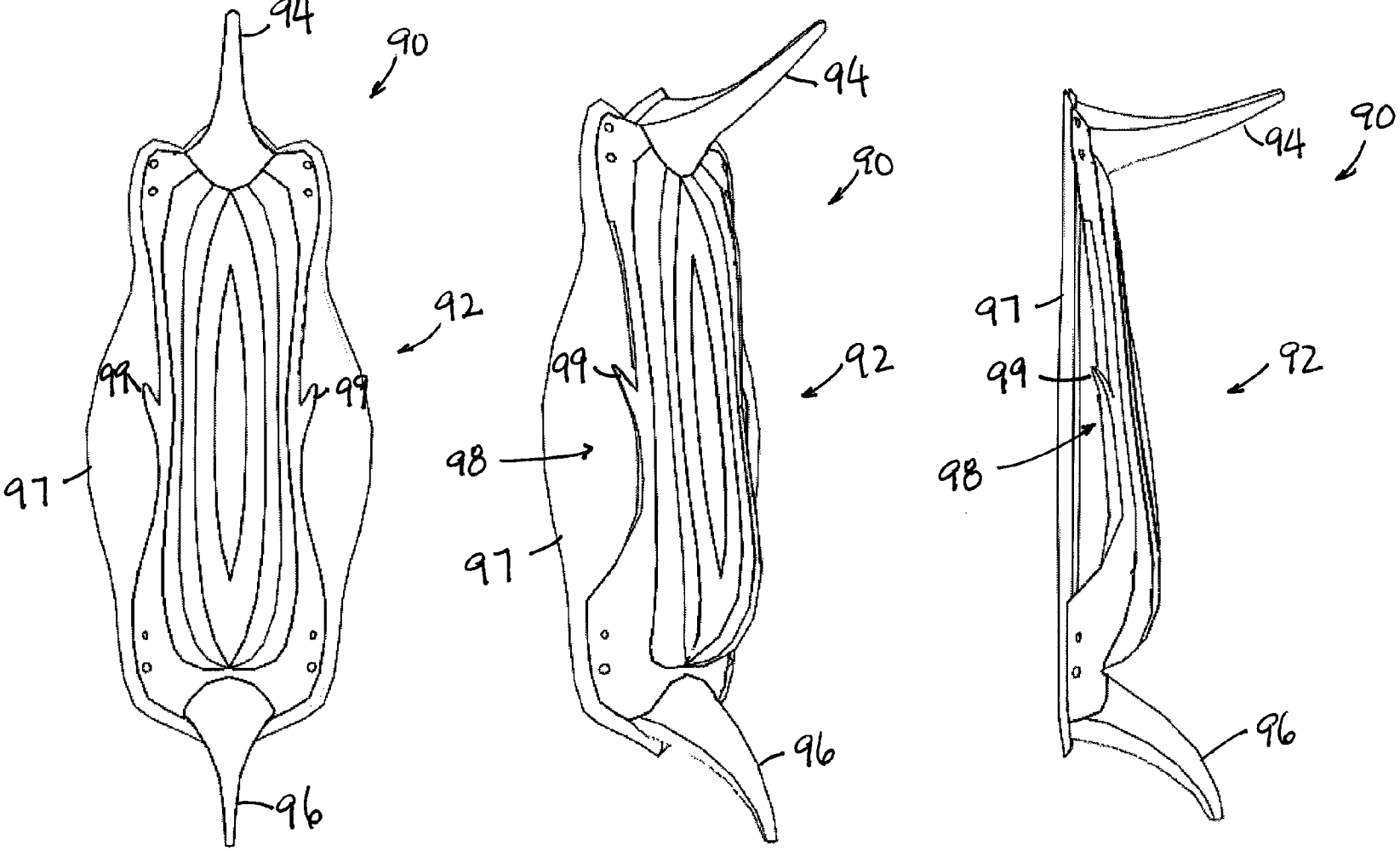
FIGS. 42A-42C are front, perspective, and side views of an embodiment of a full-body workout gym for use with the full-body workout strap according to the present disclosure.
Figure 43A:
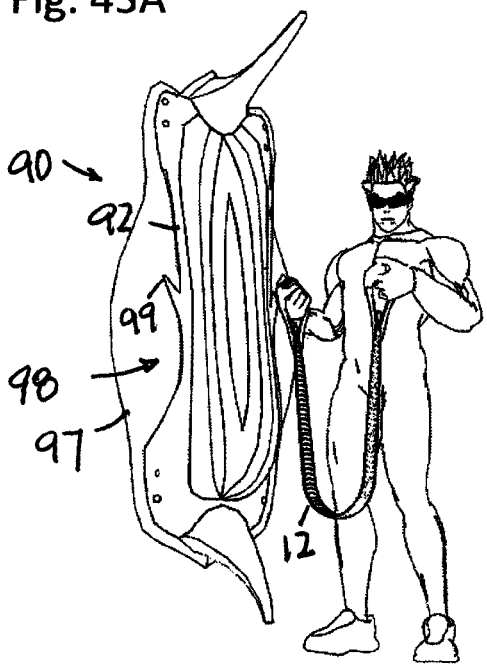
FIGS. 43A-43D are views of adding the full-body workout strap to the full-body workout gym according to the present disclosure.
Figure 43B:
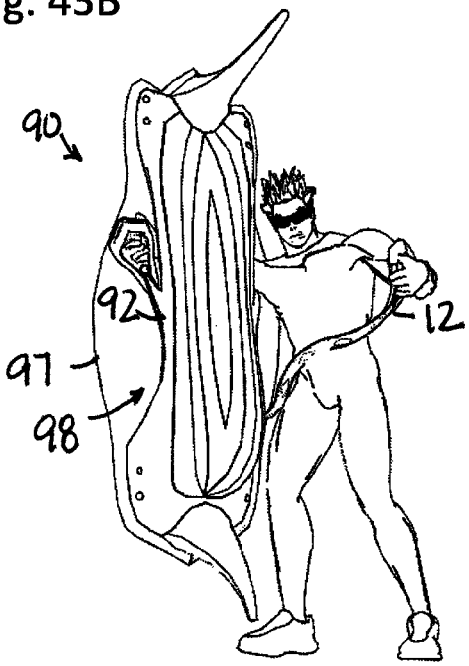
Figure 43C:
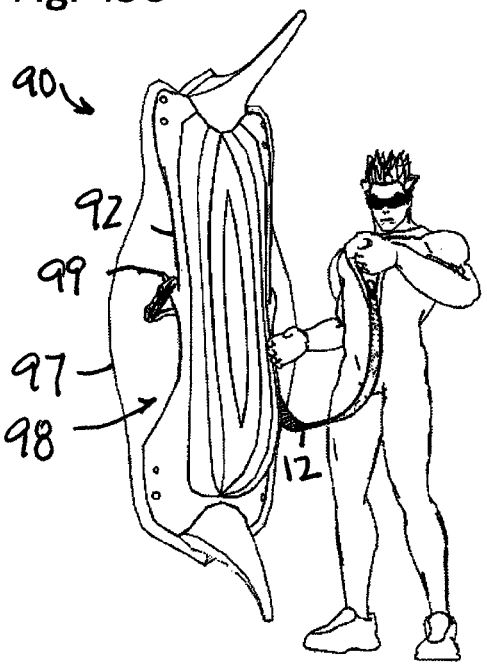
Figure 43D:
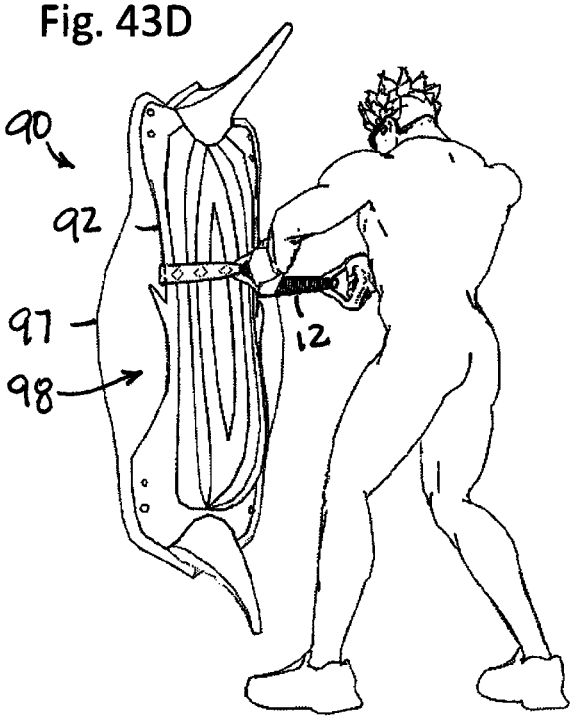
Figure 44A:
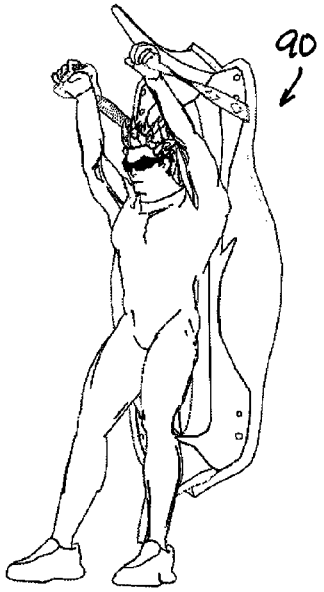
FIGS. 44A-44F are views of the various ways of using the full-body workout strap with the full-body workout gym according to the present disclosure.
Figure 44B:
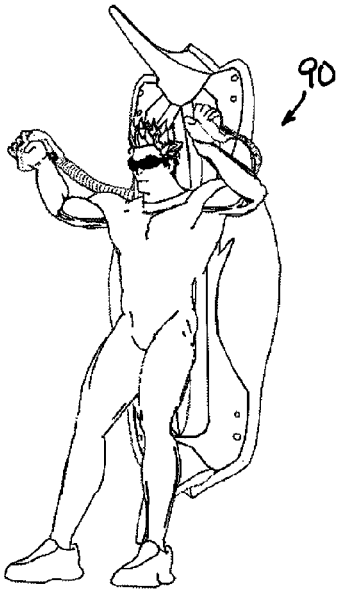
Figure 44C:
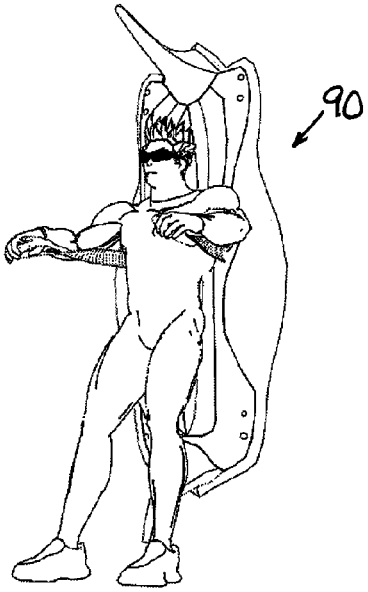
Figure 44D:
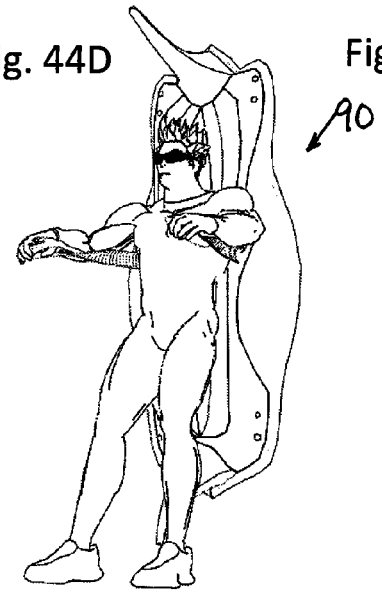
Figure 44E:
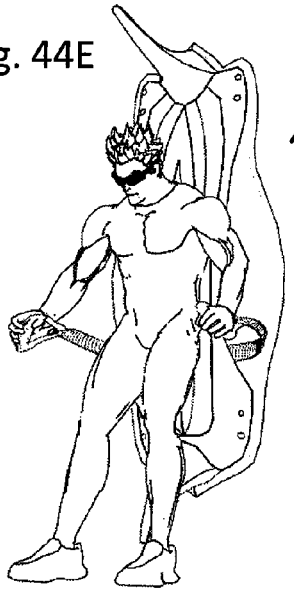
Figure 44F:
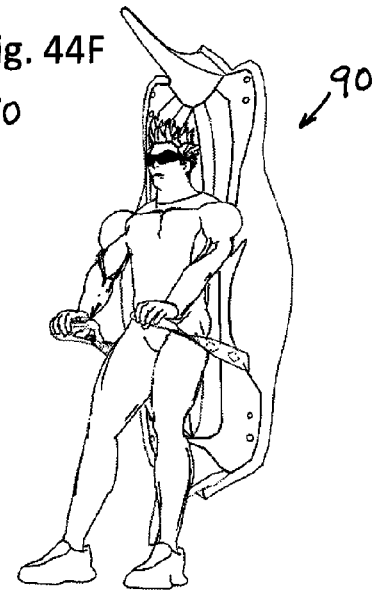
Figure 45A:
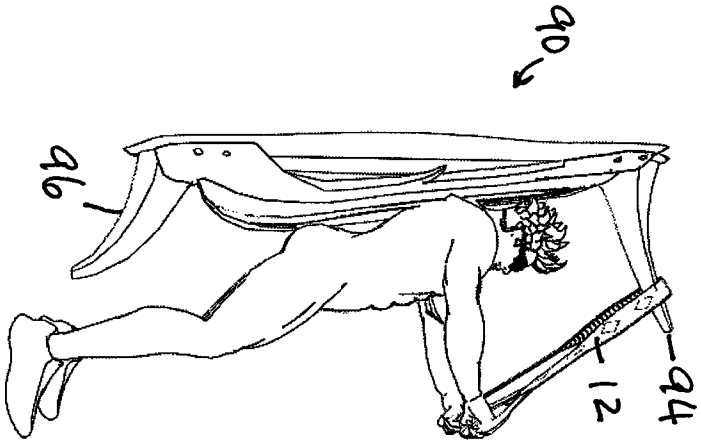
FIGS. 45A-45D are more views of the various ways of using the full-body workout strap with the full-body workout gym according to the present disclosure.
Figure 45B:
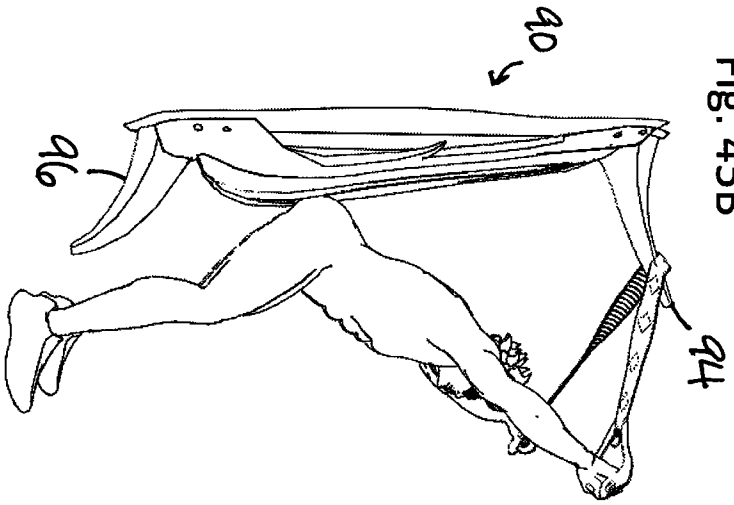
Figure 45C:
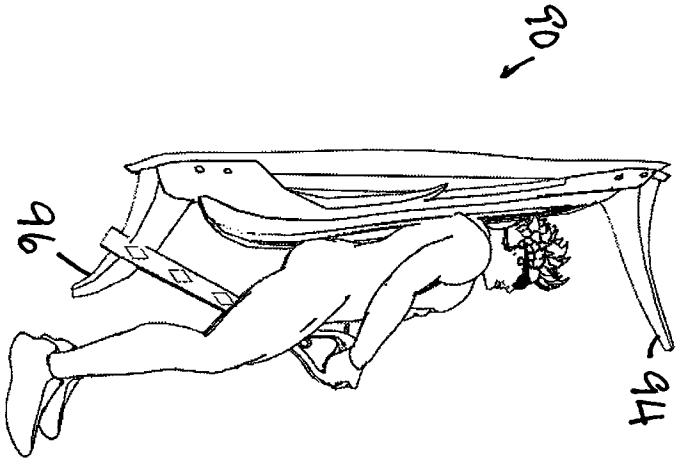
Figure 45D:
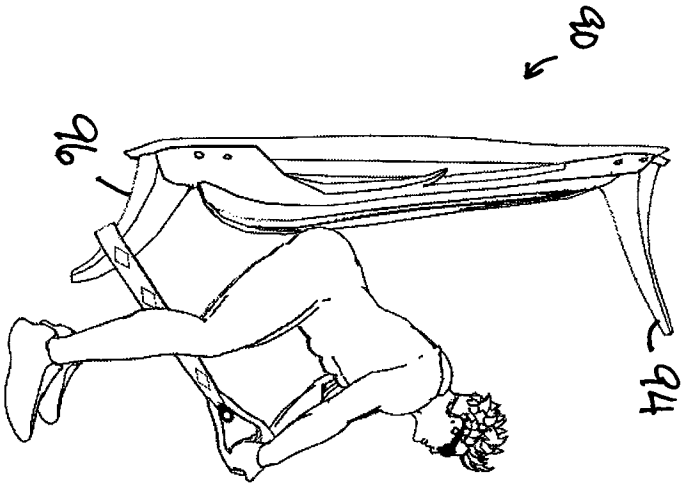
Figure 46A:
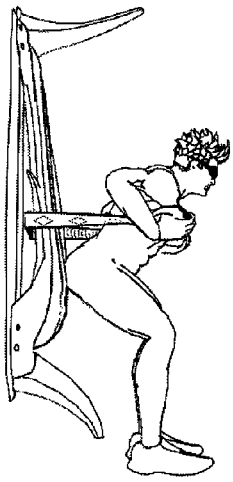
FIGS. 46A-46I are more views of the various ways of using the full-body workout strap with the full-body workout gym according to the present disclosure.
Figure 46B:
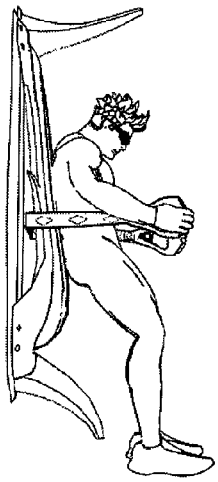
Figure 46C:
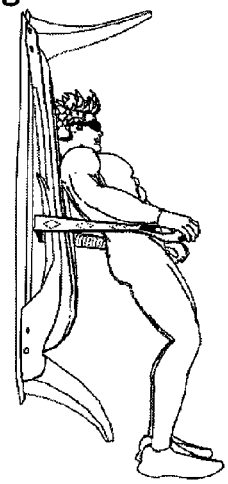
Figure 46D:
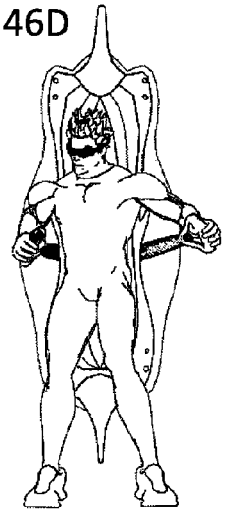
Figure 46E:
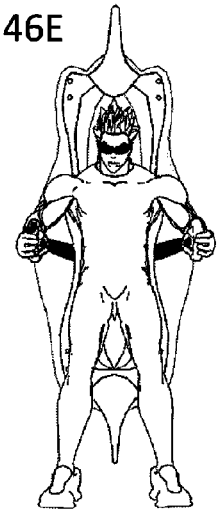
Figure 46F:
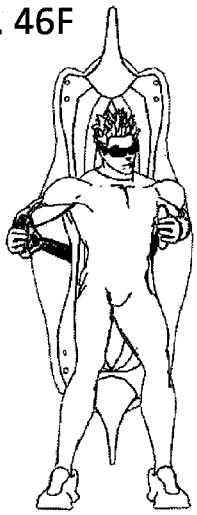
Figure 46G:
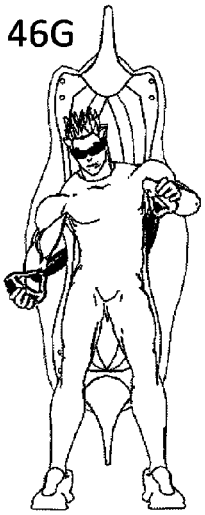
Figure 46H:
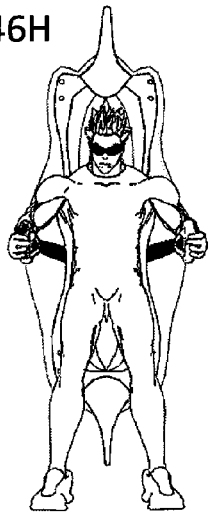
Figure 46I:
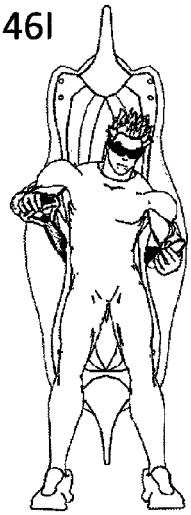

FIGS. 42A-42C are front, perspective, and side views of an embodiment of a full-body workout gym 90 for use with the full-body workout strap described above according to the present disclosure. The full-body workout gym 90 may incorporate a tree-like design with a generally vertical trunk 92, an upper generally horizontal branch member 94, and a lower generally horizontal root member 96. The vertical trunk 92 is securely fastened to a wall board 97 and a void or passageway 98 is defined between the trunk 92 and the wall board 97. The wall board 97 is generally sturdy, flat and enables the full-body workout gym 90 to be securely mounted onto a wall. The vertical trunk 92 further includes small side branches 99 that may serve as hooks for utilitarian purposes. The vertical trunk 92 is preferably contoured to mimic a tree trunk having a generally convex shape along its longitudinal axis. It may also incorporate a tapered contour from the top end to its bottom end that mimics a tree trunk. In selected locations, the contour of the vertical trunk 92 may incorporate protruding knots or other features. The vertical trunk 92 includes a padded and textured surface. The upper branch member 94 mimics a tree branch and may incorporate similar shapes and curvature. The root member 96 may incorporate a curve downward.

FIGS. 43A-43D are views of adding the full-body workout strap 12 to the full-body workout gym 90 according to the present disclosure. The user can easily pass one end of the full-body workout strap 12 from one side to the other side via the void 98 between the vertical trunk 92 and the wall board 97. The small side branches 99 may be used to temporarily hold one end of the strap 12 while it is being positioned in place.

FIGS. 44A-44F are views of the various ways of using the full-body workout strap described above with the full-body workout gym 90 according to the present disclosure. The user may easily shift or slide the full-body workout strap along the length of the vertical trunk that makes a wide range of positions and motion possible.

FIGS. 45A-45D are more views of the various ways of using the full-body workout strap described above with the full-body workout gym 90 according to the present disclosure. The user may use the upper branch member 94 to do core ab crunches and similar moves. The user may use the lower root member 96 to do dead lifts and similar moves. The user may easily switch the strap 12 from the branch member 94 to the root member 96 and back easily and quickly. As the strap 12 is not fastened to the full-body workout gym 90 using any fasteners, changing the position of the strap 12 can be done instantaneously.

FIGS. 46A-46I are more views of the various ways of using the full-body workout strap described above with the full-body workout gym described above according to the present disclosure. The user may use the strap to pull against the vertical trunk, branch member, and root member to work various parts of the body. Further, the user may press against the padded contoured trunk to achieve a massaging effect on the back and other parts of the body. One can mimic a bear rubbing its back on a tree to press against various pressure points on the back and other parts of the body. The user may roll his back against the trunk, knead the muscles, and effectively achieve a self-administered massage.

The features of the present invention which are believed to be novel are set forth below with particularity in the appended claims. However, modifications, variations, and changes to the exemplary embodiments described above will be apparent to those skilled in the art, and the portable full-body workout system and the full-body workout gym described herein thus encompass such modifications, variations, and changes and are not limited to the specific embodiments described herein.

What is claimed is:

1. A portable full-body workout system comprising:

a cooler having a hinged lid and defining an insulated compartment and a cushioned weighted bottom portion;

at least one drink bottle having a cushioned weighted bottom portion and configured for releasable attachment to the cooler;

a cooler handle configured for releasable attachment to the cooler and the at least one drink bottle;

a full-body workout strap having a strap body with first and second ends, each end including a padded hand grip and a latching mechanism configured for releasable attachment to the cooler; and wherein the at least one drink bottle is usable as a hand weight;

wherein the cooler and the at least one releasably attached drink bottle held by the cooler handle by a user are usable as a kettle bell;

wherein the at least one drink bottle held by the cooler handle by a user is usable as a kettle bell; and wherein the full-body workout strap looped around an immobile object is usable as a suspension resistance training strap.

2. The portable full-body workout system of claim 1, wherein the at least one drink bottle comprises a "dumbbell" drink bottle having a generally cylindrical insulated body.

3. The portable full-body workout system of claim 1, wherein the at least one drink bottle comprises a "sword" drink bottle having a generally tapered cylindrical insulated body.

4. The portable full-body workout system of claim 1, wherein the at least one drink bottle comprises a "knuckle" drink bottle having an insulated body with a handle portion and a knuckle portion with a space therebetween.

5. The portable full-body workout system of claim 1, wherein the strap body of the full-body workout strap comprises a surface incorporating a textured non-slip surface.

6. The portable full-body workout system of claim 1, wherein the cooler handle comprises a durable nylon cord and a handle bar rotatable about the nylon cord.

7. The portable full-body workout system of claim 1, wherein the cooler handle comprises a clip at a first end of the handle configured to fasten to a ring located on the cooler, and a ring at a second end of the handle configured to receive a clip located on the cooler, the clip at the first end further configured to clip onto the ring at the second end of the handle.

8. The portable full-body workout system of claim 1, wherein the strap body of the full-body workout strap is semi-rigid.

9. The portable full-body workout system of claim 1, wherein the latching mechanism of the full-body workout strap comprises a clip attached to each end of the strap body.

10. A full-body workout system comprising:

a cooler having a hinged lid and defining an insulated compartment and an adjustable weighted bottom portion;

at least two drink bottles having an adjustable weighted bottom portion and configured for releasable attachment to the cooler;

at least one cooler handle configured for releasable attachment to the cooler and the at least two drink bottles;

a full-body workout strap having a strap body with first and second ends, each end including a padded hand grip and a latching mechanism configured for releasable attachment to the cooler; and wherein the cooler may be carried by at least one of the at least one cooler handle and the full-body workout strap.

11. The full-body workout system of claim 10, wherein the at least two drink bottles each comprises a "dumbbell" drink bottle having a generally cylindrical insulated body.

12. The full-body workout system of claim 10, wherein the at least two drink bottles each comprises a "sword" drink bottle having a generally tapered cylindrical insulated body.

13. The full-body workout system of claim 10, wherein the at least two drink bottles each comprises a "knuckle" drink bottle having an insulated body with a handle portion and a knuckle portion with a space therebetween.

14. The full-body workout system of claim 10, wherein the strap body of the full-body workout strap comprises a surface incorporating a textured non-slip surface.

15. The full-body workout system of claim 10, wherein the at least one cooler handle comprises a durable nylon cord and a handle bar rotatable about the nylon cord.

16. The full-body workout system of claim 10, wherein the at least one cooler handle comprises a clip at a first end of the handle configured to fasten to a ring located on the cooler, and a ring at a second end of the handle configured to receive a clip located on the cooler, the clip at the first end further configured to clip onto the ring at the second end of the handle.

17. The full-body workout system of claim 10, wherein the strap body of the full-body workout strap is semi-rigid.

18. The full-body workout system of claim 10, wherein the latching mechanism of the full-body workout strap comprises a clip attached to each end of the strap body.

19. The full-body workout system of claim 10, wherein the bottom portions of the at least two drink bottles and the cooler comprise a textured non-slip surface.

20. The full-body workout system of claim 10, further comprising a full-body workout gym having a generally vertical trunk member secured to a wall, a branch member disposed at a top end of the trunk member and extending generally horizontally therefrom, and a root member disposed at a bottom end of the trunk member and extending generally horizontally therefrom, the generally vertical trunk member defining a void between the trunk member and the wall configured for receiving the full-body workout strap.

21. A full-body workout system comprising:

a cooler having a hinged lid and defining an insulated compartment and an adjustable weighted bottom portion;

at least two drink bottles having an adjustable weighted bottom portion and configured for releasable attachment to the cooler;

at least one cooler handle configured for releasable attachment to the cooler and the at least two drink bottles;

a full-body workout strap having a strap body with first and second ends, each end including a padded hand grip and a latching mechanism configured for releasable attachment to the cooler; and a generally vertical trunk member secured to a wall, a branch member disposed at a top end of the trunk member and extending generally horizontally therefrom, and a root member disposed at a bottom end of the trunk member and extending generally horizontally therefrom, the generally vertical trunk member defining a void between the trunk member and the wall configured for receiving the full-body workout strap.

* * * * *